US006519442B2

(12) United States Patent
Matsuzuki

(10) Patent No.: US 6,519,442 B2
(45) Date of Patent: Feb. 11, 2003

(54) APPARATUS FOR PRINTING ON CONTINUOUS PAPER AND A DEVICE FOR STACKING THE PAPER

(75) Inventor: Masato Matsuzuki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/895,327

(22) Filed: Jul. 2, 2001

(65) Prior Publication Data

US 2002/0085869 A1 Jul. 4, 2002

(30) Foreign Application Priority Data

Dec. 28, 2000 (JP) ..... 2000-399681

(51) Int. Cl.[7] ..... G03G 15/00; B31B 1/26
(52) U.S. Cl. ..... 399/384; 493/411
(58) Field of Search ..... 399/375, 381, 399/384, 405; 226/42, 95, 111, 176, 177, 178, 195, 30, 31; 493/405, 409, 411, 412

(56) References Cited

U.S. PATENT DOCUMENTS 4,358,285 A * 11/1982 Fujino ..... 493/411
4,723,488 A * 2/1988 Inouye et al. ..... 493/411 X
5,809,390 A * 9/1998 Jackson ..... 399/384
6,066,082 A * 5/2000 Suketomo ..... 493/411

FOREIGN PATENT DOCUMENTS

JP 58-139968 8/1983

* cited by examiner

*Primary Examiner*—Hoan Tran
(74) *Attorney, Agent, or Firm*—Armstrong, Westerman & Westerman, LLP

(57) ABSTRACT

An apparatus for printing continuous paper wherein, when a paper uppermost portion sensor produces an unstable output due to the position of the paper in controlling the operation for raising or lowering a table for stacking the continuous paper, the output value is invalidated and the operation for raising or lowering the table is continued. The sensor detects the uppermost position of the paper on the paper table on which the continuous paper carried through a printer unit is folded by a guide member and is stacked, and a control unit controls a moving mechanism relying upon the sensor output to change the distance between the paper table and the guide member. When the sensor is producing an unstable output due to the position of the paper being stacked, the control unit works to continue the operation of the moving mechanism even when the sensor has detected the paper.

16 Claims, 19 Drawing Sheets

Fig.17
| FOLDING LENGTH | 7 INCHES | 7.5 INCHES | 8 INCHES | - - - |
|---|---|---|---|---|
| MOUNTAIN PERFORATION | A | C | E | - - - |
| VALLEY PERFORATION | B | D | F | - - - |
Fig.18
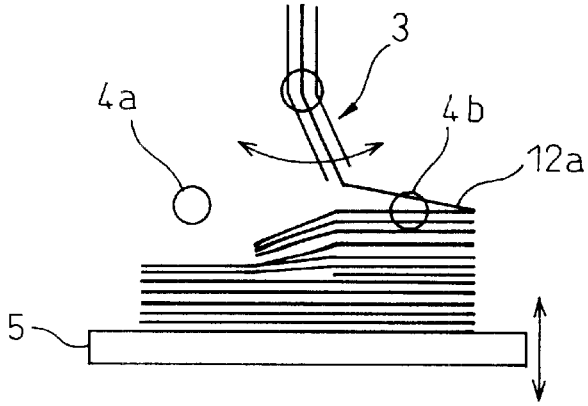
Fig.19
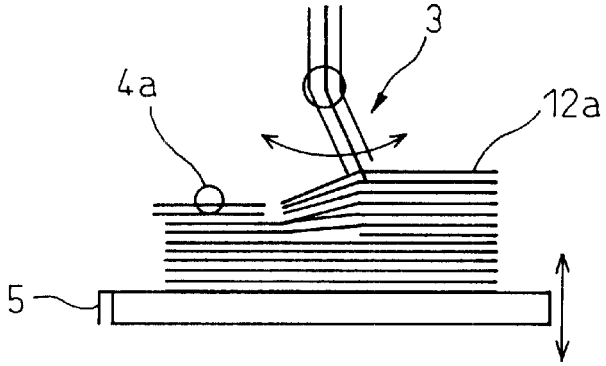

APPARATUS FOR PRINTING ON CONTINUOUS PAPER AND A DEVICE FOR STACKING THE PAPER

BACKGROUND OF THE INVENTION

1. Field of the Invention

The present invention relates to an apparatus for printing on continuous paper having a function for stacking the continuous paper after it is printed, and to a device for stacking the paper. More particularly, the invention relates to an apparatus that is suited for moving paper at high speed.

2. Description of the Related Art

An ordinary continuous paper has a perforation after each page and is folded at a mountain perforation and at a valley perforation. The paper carried by a tractor from a printer unit is folded along the perforation in a zig-zag manner by a paper-folding mechanism and is stacked on a paper table.

Here, a predetermined positional relationship must be maintained at all times between the uppermost position of the paper that is stacked and the folding mechanism in order to correctly stack the paper on the table maintaining a folding precision at the perforations of the paper relative to the folding mechanism.

So far, the uppermost position of the stacked paper has been detected and has been so controlled that the uppermost portion of the paper that is stacked lies within a specified range at all times. That is, according to the prior art, after the start of printing, an interval is set for periodically lowering the paper table. After the interval has elapsed, the paper table is greatly lowered and is, then, gradually raised. In the step of raising the paper table, it is checked whether there is paper at the uppermost portion. When paper is detected, the paper table is halted. When no paper is detected, the paper table continues to rise. According to the conventional control operation as described above, the operation is repeated in that the paper table is greatly lowered at regular time intervals and is, then, raised until the upper end of the paper arrives at the sensor position.

When the paper-folding mechanism swings right and left to fold the paper along the perforation, however, the paper just before being stacked shades the sensor that detects the uppermost portion of the paper depending upon the swinging angle, and the sensor often incorrectly detects paper though it really does not exist. The sensor for detecting the uppermost portion of the paper is constituted by an opposing pair of light-emitting element and light-receiving element, and the presence of the paper is detected by relying upon the interruption of light. Therefore, when the paper, just before being folded, temporarily interrupts light to the light-receiving element due to the angle of the paper-folding mechanism, the sensor judges that the paper exists. In this case, therefore, the paper table comes into a halt.

Thus, the position of the paper-folding mechanism that swings temporarily causes the sensor to lose stability due to interruption of light to the sensor by the paper, just before being folded, hindering the detection of the uppermost portion of the really stacked paper while permitting, in other moments, the sensor to accomplish the normal detection. These two states periodically occur while the paper-folding mechanism is swinging.

In the state where the sensor that detects the uppermost portion of the paper is producing an unstable output, it happens that the paper table is regarded to have pushed the uppermost portion of the paper to a predetermined height if the sensor that detects the uppermost portion malfunctions even though the paper table is really at a low position separated away from the paper-folding mechanism.

Therefore, when the sensor that detects the uppermost portion of the paper produces an unstable output while the paper table is being raised, the operation for raising the paper table is discontinued though the paper table is not really pushing up the uppermost portion of the paper to a predetermined height. Then, when the paper-folding mechanism moves in excess of a state where the sensor produces an unstable output, the sensor normally detects the presence of no paper. Accordingly, the operation for raising the table is resumed. According to the conventional control operation, therefore, the paper table finally arrives at the predetermined height after having repeated the raising and stopping several times.

The operation for repetitively raising and stopping of the paper table exerts a burden on the motor for raising and lowering the table. Besides, the behavior of when the paper table is brought into a halt adversely affects the operation for precisely raising or lowering the paper table so that the uppermost portion of the paper lies within a predetermined range.

So far, despite the paper table being intermittently raised or lowered as described above, the speed for carrying the paper is not so high and the performance of the electric motor for raising or lowering the table follows the rate for stacking the papers on the table. Therefore, the height of the paper table could be controlled to meet the practical use.

According to another prior art, provision is made of plural sensors for detecting the uppermost surface of the paper, and the rise of the table is halted when the uppermost portion is detected by all of the sensors. This makes it possible to conduct the control operation by taking into consideration the case where the upper surface of the stacked paper is irregular.

In raising the paper table up to a specified position, too many times of repetition of stopping and raising, as in the conventional operation for raising and lowering the paper table, exerts a burden on the motor for raising and lowering the paper table, requires additional electric power for driving the motor and shortens the life of the motor.

Besides, it is a tendency to carry the papers at sharply increasing speeds to meet the modern demand for executing the printing processing at high speed. At present, a paper of 11 inches is discharged and stacked in an amount of 5 to 6 pieces a second reckoned as an A4-size. In the future, it is expected that the paper will be discharged in further increased amounts, and the paper-folding mechanism swings at a correspondingly increased speed. Therefore, if the sensor that detects the uppermost portion of the paper periodically produces outputs in a normal state and in an unstable state, the stopping and raising of the paper table are repeated at high speeds and an increased burden is exerted on the motor for raising and lowering the paper table. Further, upon receiving a burden, the motor becomes no longer capable of operating as instructed. Due to the repetition of the movement of the paper table, further, the paper may often not be stacked to a specified amount.

As means for solution, it can be contrived to use a motor of high performance that withstands high-speed operation for driving the table and to increase the raising/lowering speed. This, however, causes a great increase in the cost of the table drive mechanism. Further, if the speed of the table is simply increased, the motor overruns at the time when the paper table is brought into a halt resulting in a decrease in the precision in the height of the paper table.

In recent years, further, printing has been executed in a variety of modes, such as printing a paper on which a thick medium like a card has been stacked and printing a dense image on half of the paper. Due to the kind of the paper or due to deviated printing, therefore, the uppermost surface of the paper stacked on the table often becomes inclined in the right-and-left direction.

When the paper is to be stacked in this state, means for detecting the uppermost portion provided in a number of only one detects the paper. When the paper table is brought into a halt, a high portion of the uppermost surface of the paper that is inclined may already be higher than the specified position causing inconvenience such as defective stacking, damage to the paper, etc.

According to the above conventional control method having plural sensors for detecting the uppermost portion and in which the rise of the table is halted when the uppermost surface is detected by all of the sensors, an irregular surface of the stacked paper can be brought into consideration, which, however, is not fully effective in detecting the papers that are stacked in a deviated manner.

SUMMARY OF THE INVENTION

It is therefore an object of the present invention to provide an apparatus for printing continuous paper and a device for stacking the paper capable of stacking the papers maintaining good precision without exerting a burden on the motor for raising and lowering, by simply using a conventional motor mechanical portion for raising and lowering and, hence, without greatly driving up the cost, featuring a simple constitution and lending itself well to high-speed processing.

Another object of the present invention is to provide an apparatus for printing continuous paper at high speed and a device, for stacking the paper, capable of smoothly raising and lowering the paper table irrespective of the position of the paper-folding mechanism as a result of not using the unstable output of the sensor that detects the uppermost portion of the paper.

In order to accomplish the above-mentioned objects, the present invention deals with an apparatus for printing a continuous paper comprising:

a printer unit for printing a continuous paper;

a paper table on which the continuous paper carried through the printer unit is folded and stacked;

an uppermost portion sensor for detecting the uppermost position of the paper stacked on the paper table;

a guide mechanism for guiding the continuous paper to the paper table;

a moving mechanism for changing the distance between the paper table and the guide mechanism; and a control circuit for controlling the moving mechanism based on the output of the uppermost portion sensor to change the distance between the paper table and the guide mechanism;

wherein, when the uppermost portion sensor is producing an unstable output due to the paper being stacked, the control circuit so works that the moving mechanism continues its operation even when the uppermost portion sensor has detected the paper.

Even when the sensor is producing an unstable output as in a state where the paper being stacked is shading the sensor, therefore, such an unstable output is not used and, hence, a wasteful operation is not effected. Accordingly, the distance between the paper guide mechanism and the paper table can be changed without exerting an excess load on the moving mechanism such as the motor for raising and lowering the paper table, and the paper can be stacked on the paper table to meet the high-speed processing.

The invention further deals with an apparatus for printing a continuous paper comprising:

a printer unit for printing a continuous paper;

a paper-folding mechanism for successively folding the continuous paper carried through the printer unit;

a paper table for stacking the folded paper;

a table-moving mechanism for moving the paper table up and down;

an uppermost portion sensor for detecting the uppermost position of the paper stacked on the paper table; and a control circuit for controlling the rising/lowering motion of the paper table based on the output of the uppermost portion sensor;

wherein, when the uppermost portion sensor is producing an unstable output due to the paper as before being stacked, the paper table continues to operate even when the uppermost portion sensor has detected the paper.

Even when the sensor is producing an unstable output as in a state where the paper being stacked is shading the sensor, therefore, the paper table continues to operate. Accordingly, the distance between the uppermost position of the stacked paper and the paper-folding mechanism is maintained constant without exerting a load on the drive motor of the paper table-moving mechanism, and the paper can be stacked during high-speed processing.

The invention further deals with an apparatus for printing continuous paper comprising:

a printer unit for printing continuous paper;

a paper-folding mechanism for successively folding the continuous paper carried through the printer unit;

a paper table for stacking the folded paper;

a table-moving mechanism for moving the paper table up and down;

an uppermost portion sensor for detecting the uppermost position of the paper stacked on the paper table; and a latch signal-holding circuit for holding the output of the sensor;

wherein, when the uppermost portion sensor is producing an unstable output due to the position of the paper-folding mechanism, a latch signal is formed so that the latch signal-holding circuit will not change its output, and the rising/lowering motion of the paper table is controlled by the latch signal.

Even when the uppermost portion sensor is producing an unstable output, as in a state where the sensor is shaded by the paper due to the position of the paper-folding mechanism, the value detected the previous time is held as a latch signal. The uppermost portion of the paper is detected by regarding the latch signal to be the output of the uppermost portion sensor enabling the paper table to be raised and lowered. There is thus provided an apparatus that allows high-speed processing.

The invention according to a further aspect deals with an apparatus for printing continuous paper comprising:

a printer unit for printing continuous paper;

a paper-folding mechanism for successively folding the continuous paper carried through the printer unit;

a paper table for stacking the folded paper;

a moving mechanism for moving the paper table up and down;

plural uppermost portion sensors provided at different positions facing the paper-folding mechanism for detecting the uppermost position of the paper stacked on the paper table; and plural latch signal-holding circuits for holding the outputs of the plural uppermost portion sensors;

wherein, when the uppermost portion sensors are producing unstable outputs due to the position of the paper-folding mechanism, latch signals are formed so that the latch signal-holding circuits will not change their outputs, and the movement of the paper table is controlled when one or more of the plural latch signals have detected the uppermost portion of the paper.

By avoiding the state where the uppermost portion sensors produce unstable outputs, it is possible to detect the uppermost portion of the paper in a more reliable state and, hence, to control the rising/lowering motion of the paper table while maintaining good precision.

Further, even when the papers are stacked in a deviated manner, the paper-folding mechanism and the uppermost position of the paper can be so controlled as to lie within a specified range at all times.

BRIEF DESCRIPTION OF THE DRAWINGS

The present invention will be more clearly understood from the description as set forth below with reference to the accompanying drawings, wherein:

FIGS. 3D to 3G are for illustrating the operation of the device for stacking the paper according to the invention, wherein FIG. 3D is a view illustrating a state where the paper table is halting, FIG. 3E is a view illustrating a state where the paper is being stacked on the paper table, FIG. 3F is a view illustrating a state where the paper table is greatly lowered from the position of FIG. 3D, and FIG. 3G is a view illustrating a state where the paper table is rising from the state of FIG. 3E;

FIG. 17 is a diagram illustrating the constitution of a ROM table;

FIG. 18 is a diagram illustrating a deviated state of the upper surface of the paper in an ideal state;

FIG. 19 is a diagram illustrating a deviated state of the upper surface of the paper in a state where the paper table is too high.

DESCRIPTION OF THE PREFERRED EMBODIMENTS

Figure 1A:
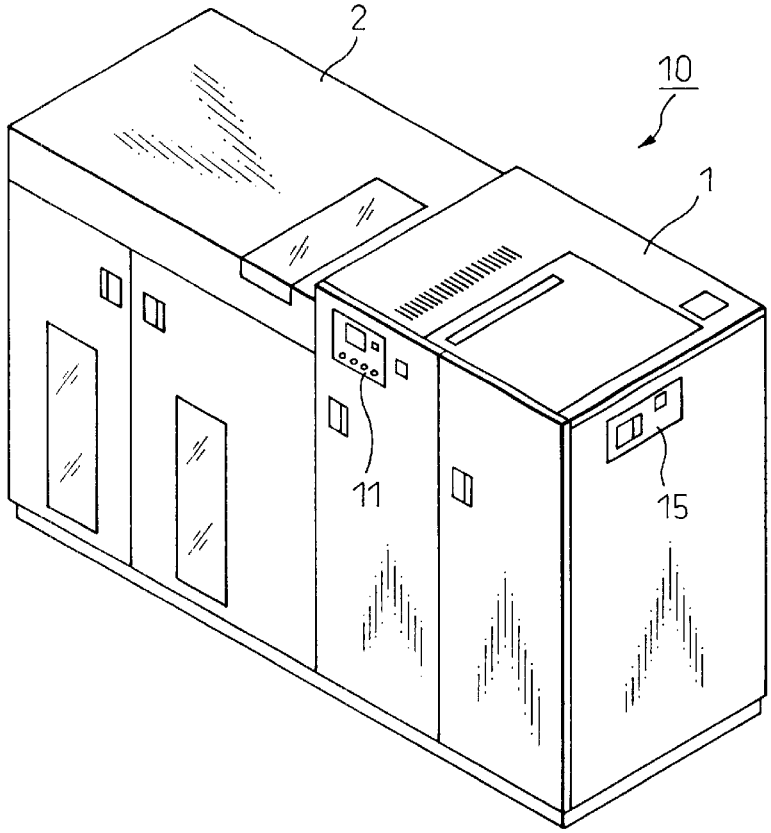
FIG. 1A is a perspective view illustrating the whole constitution of an apparatus for printing a continuous paper according to the present invention.

FIG. 1A illustrates the whole constitution of a device 10 for printing a continuous paper according to the present invention. Referring to FIG. 1, the apparatus 10 for printing the continuous paper includes a printer unit 1 for printing the paper and a device 2 for stacking the paper on which the continuous paper discharged from the printer unit 1 is successively folded and stacked. The printer unit 1 includes a main operation panel 11 having a liquid crystal display panel and function switches, and a sub-operation panel 15 provided with a small door and in which a power switch and the like are provided.

Figure 1B:
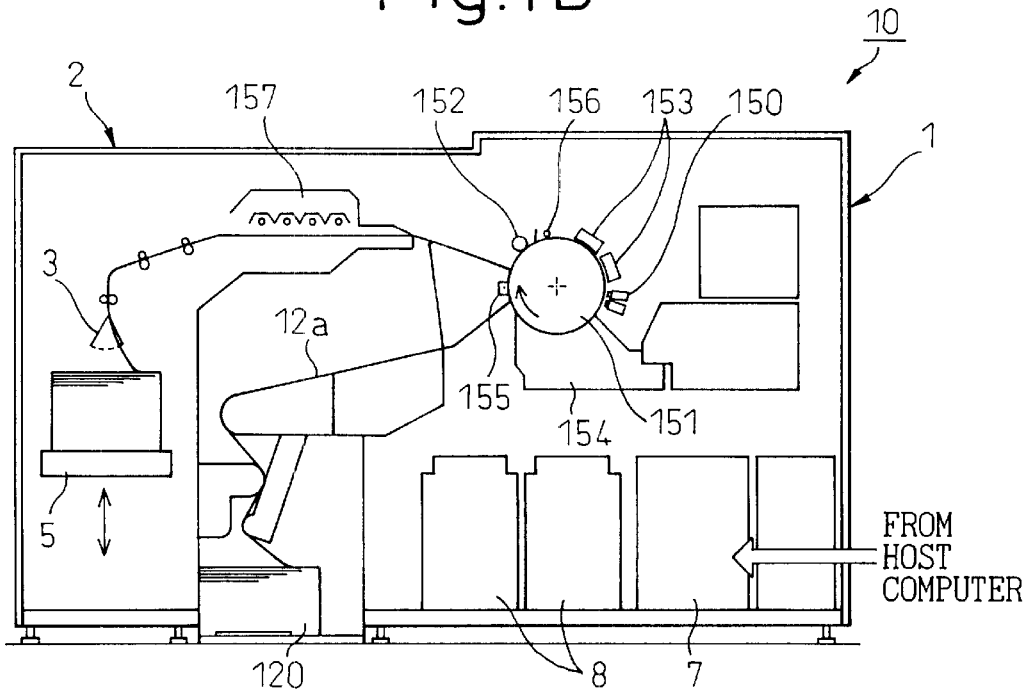
FIG. 1B is a side view illustrating the internal constitution of the apparatus for printing the continuous paper shown in FIG. 1A.

FIG. 1B is a view illustrating the internal constitution of the apparatus 10 for printing the continuous paper shown in FIG. 1A. The apparatus 10 for printing the continuous paper includes a control unit 7 having a timer and a page buffer. Data in an amount of one page are transferred and stored in the page buffer each time from a host (CPU) that is not shown. Reference numeral 8 denotes power sources for the apparatus 10 for printing the continuous paper. The data of one page are taken out from the page buffer of the control unit 7 and, then, an image pattern is recorded onto a photosensitive drum 151 with a beam from an optical unit 150. The drum 151 is surrounded by an electric charger 153, an electric charge remover 156, a cleaner 152, a transfer unit 155 and a developer 154 in a direction opposite to the rotational direction starting from the optical unit 150. A folded paper 12*a* is drawn from a paper-feed unit 120. An image is formed on the paper through the transfer unit 155, and is fixed thereon through a fixing unit 157. The paper is then folded by a paper-folding mechanism 3 and is stacked on the paper table 5.

Figure 2A:
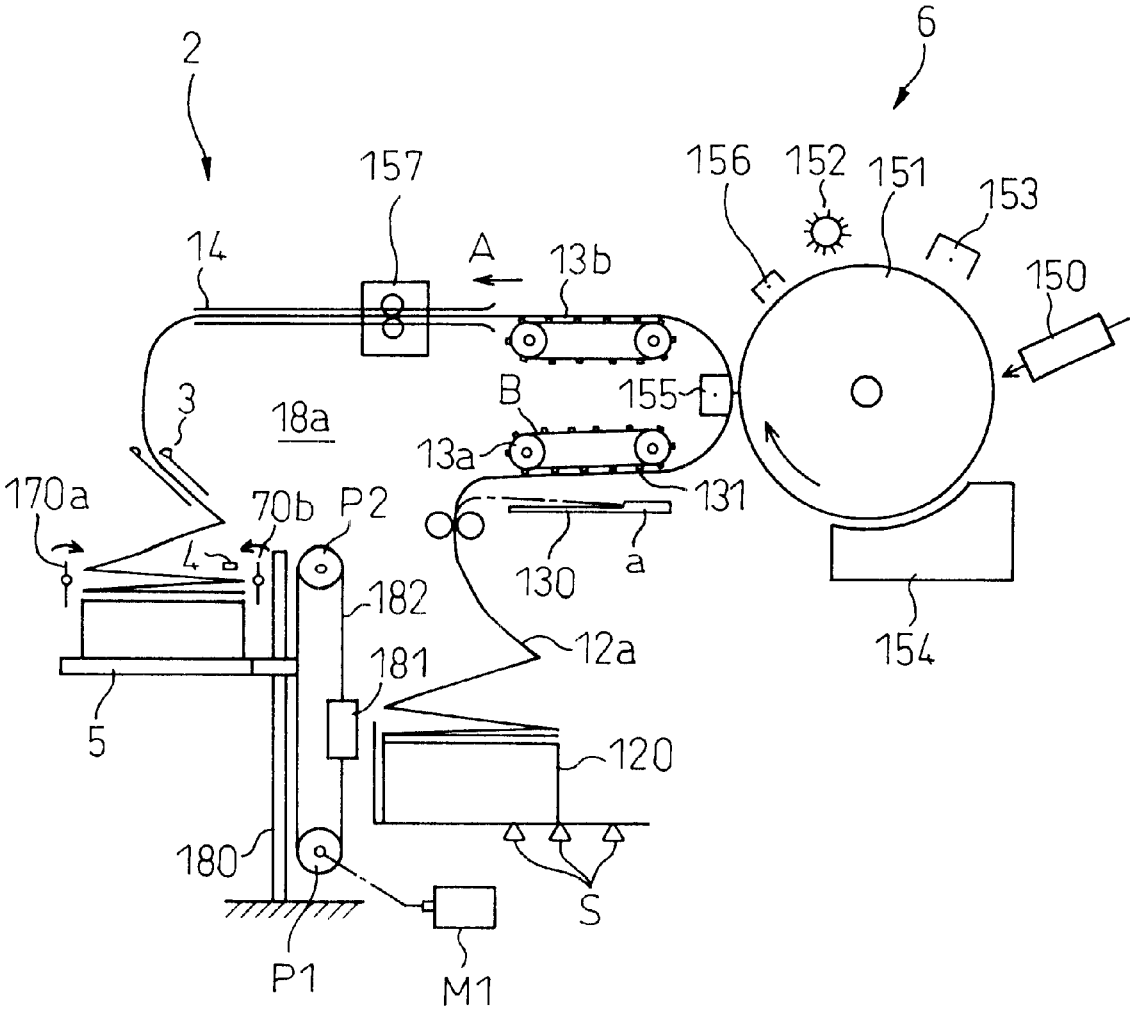
FIG. 2A is a view illustrating, on an enlarged scale, the constitution of a device for stacking the paper according to the present invention in the internal constitution of FIG. 1B.
Figure 2B:
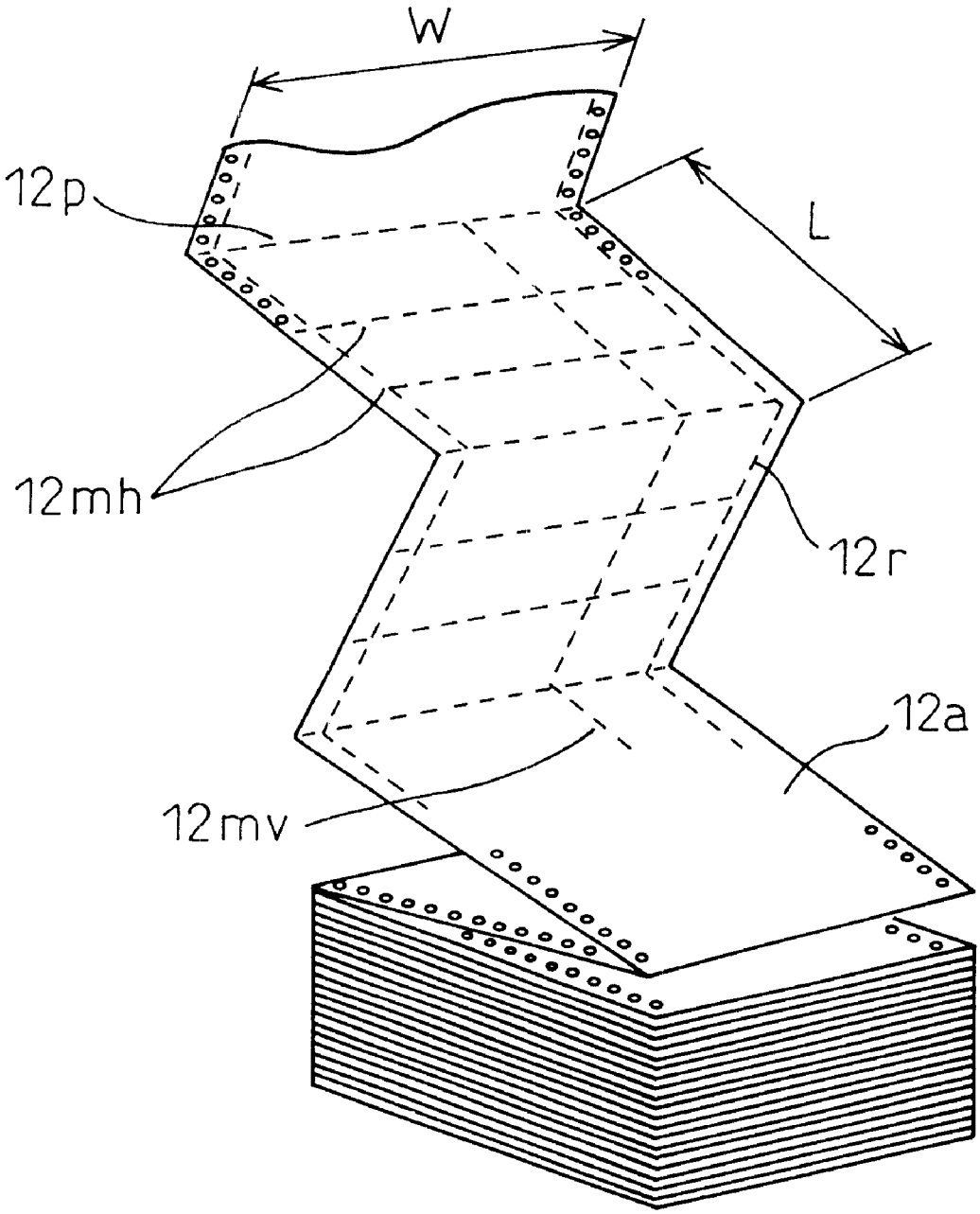
FIG. 2B is a perspective view of a continuous paper used in the present invention.

FIG. 2A illustrates, on an enlarged scale, the portions of a print-processing unit 6 and a paperstacking device 2 in the internal constitution shown in FIG. 1B. In this embodiment, the paper-folding mechanism 3 works as a swing guide. Referring to FIG. 2B, the paper 12*a* used in this embodiment has a folding perforation (page perforation) 12*p* after every folding length (longitudinal size of the paper) L. Depending upon the use, the paper 12*a* may be provided with a right perforation 12*r,* an intermediate longitudinal perforation 12*mv* and an intermediate transverse perforation 12*mh.* W denotes the width of the paper.

In FIG. 2A, reference numeral 120 denotes a paper-feeding unit in which is held the paper 12*a,* in an integrated manner, folded along the perforations, 13*a* and 13*b* denote tractors, 130 denotes an automatic loading table, 14 denotes a carrier passage, 6 denotes the print-processing unit, 3 denotes a swing guide which is the paper-folding mechanism, 5 denotes a paper table on which the printed paper 12*a* is stacked being folded along the perforations, 18*a* denotes a lift mechanism for raising and lowering the paper table 5, and 4 denotes a sensor for detecting the uppermost portion of the paper.

The print-processing unit 6 is constituted by the optical unit 150, photosensitive drum 151 on which the image is to be formed, cleaner 152, electric charger 153, developer 154, transfer unit 155, electric charge remover 156 and fixing unit 157.

The lift mechanism 18*a* is constituted by a guide shaft 180 for guiding the rising/lowering motion of the paper table 5, a timing belt (hereinafter referred to as belt) 182 to which are attached the paper table 5 and a weight 181, pulleys P1 and P2 around which the belt 182 is wrapped, and a motor M1 coupled to the pulley P1. Upon driving the motor M1, the paper table 5 moves up and down.

The lower-limit position of the paper table 5 is a home position. When the printing has finished or when a miss stacking is detected, the paper table 5 is lowered to the home position.

An operator sets the perforation of the paper 12*a* to a specified position a on the automatic load table 130 and depresses an automatic load button that is not shown. Upon depressing the automatic load button, the automatic load table 130 moves in the direction of the tractor 13*a* due to a drive mechanism that is not shown. Further, the feed holes at both ends of the paper engage with sprockets 131 provided for the belt B of the tractor 13*a*. As the tractors 13*a* and 13*b* operate, therefore, the paper 12*a* is fed by a predetermined amount in the direction of an arrow A.

The paper 12*a* is guided passing through the swing guide 3 and comes into a halt as the end of the paper 12*a* arrives at a position on the paper table 5 where the paper can be stacked being folded at the perforation formed in the paper 12*a.* This is a print standby state.

The home position of the swing guide 3 is at a vertical position. To start the printing, therefore, the start position of the swing guide 3 is determined to meet the size of the paper 12*a* that is set and to meet the mountain and valley of the perforation, and the swing guide 3 is moved to the thus determined position to stand by. When the paper 12*a* has already passed through the swing guide 3 at the time when the power source of the apparatus is closed, the swing guide 3 is moved closer to the perforation, and this position is used as a start position to stand by.

Then, when the fixing unit 157 is heated at a predetermined temperature, a print-possible state is established. Electric charge has already been removed from the photosensitive drum 151 by the electric charge remover 156, the residual toner is cleaned by the cleaner 152, and the photosensitive drum is charged again by the electric charger 153.

Due to a print instruction, light emitted from the optical unit 150 constituted by a source of laser light scans the surface of the photosensitive drum 151 to form thereon an electrostatic latent image corresponding to the print data. The electrostatic latent image formed on the photosensitive drum 151 is developed into a toner image by the developer 154 and is transferred onto the paper 12*a* that is conveyed through the transfer unit 155. The toner image transferred onto the paper 12*a* is fixed by the fixing unit 157.

The paper 12*a* carried from the printer unit is folded along the perforation as the swing guide 3 swings toward the right and left, and is stacked on the paper table 5.

The initial position of the swing guide 3 at the time of starting the printing is set depending upon the length of the paper that has been input in advance and upon the setting of folding lines along the mountain perforation and the valley perforation. After the start of printing, the swing guide is controlled to travel a round trip over the length up to the folding line of the paper, over a length of from the mountain side of the perforation to the valley side of the perforation taking a time two times as long as the carrying time. During the printing, therefore, the position of the swing guide 3 is exclusively controlled and determined by the elapse of time from the start of printing.

Figure 3A:
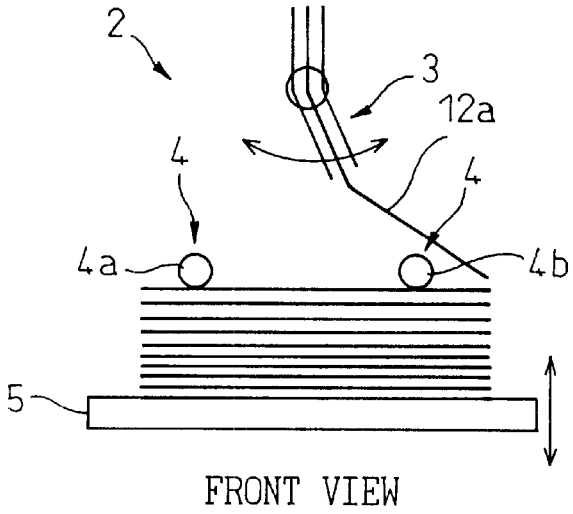
FIG. 3A is a front view illustrating the device for stacking the paper according to an embodiment of the present invention.
Figure 3B:
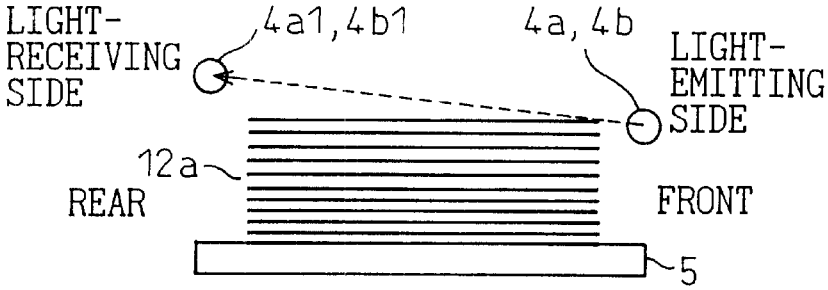
FIG. 3B is a side view illustrating the arrangement of a sensor for detecting the uppermost portion of the paper in the device for stacking the paper of the invention.
Figure 3C:
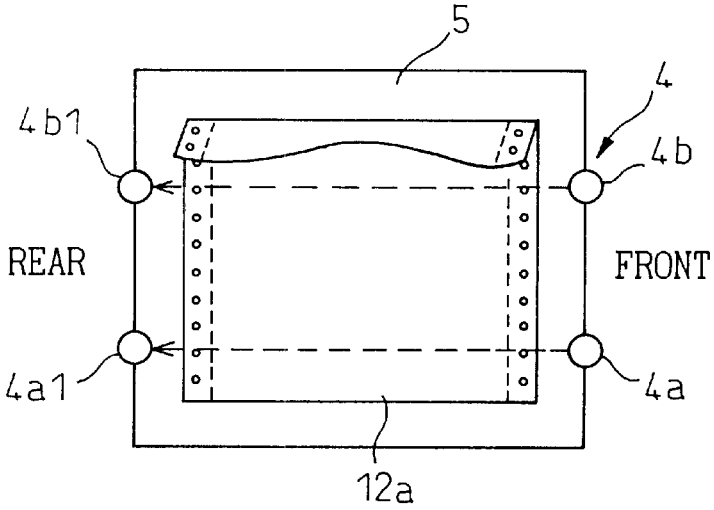
FIG. 3C is a plan view illustrating the arrangement of the sensors for detecting the uppermost portion of the paper in the device for stacking the paper of the invention.

FIG. 3A is a front view of a portion where there are provided the swing guide 3, paper table 5 and sensors 4 for detecting the uppermost portion of the paper 12*a* in the paper-stacking device 2 according to an embodiment of the present invention, FIG. 3B is a side view of a portion of FIG. 3A, and FIG. 3C is a view of when the sensors 4 and the paper 12*a* of FIG. 3B are viewed from the upper side.

This embodiment deals with a case where the sensors 4 for detecting the uppermost portion of the paper 12*a* are provided in two sets (a set of sensors 4*a* and 4*a*1, and another set of sensors 4*b* and 4*b*1).

As shown in FIGS. 3A to 3C, the two sets of sensors 4 for detecting the uppermost portion of the paper 12*a* are constituted by light-emitting elements 4*a,* 4*b* and light-receiving elements 4*a*1, 4*b*1, the light-emitting elements 4*a* , 4*b* being positioned on the front side of the device and the light-receiving elements 4*a*1, 4*b*1 being positioned on the back side of the device.

When the paper exists between the light-emitting element 4*a* and the light-receiving element 4*a*1, and between the light-emitting element 4*b* and the light-receiving element 4*b*1, light is interrupted and the presence of the paper 12*a* is detected.

Here, the conventional operation for stacking the paper 12*a* on the paper table 5 will be described with reference to FIGS. 3D to 3G. The paper table 5 according to this embodiment stays halted for a predetermined period of time to have the paper 12*a* stacked thereon and, then, is greatly lowered once. The paper table 5 then gradually rises from the lowered position and discontinues to rise in a state where the paper 12*a* stacked thereon is detected by the sensors 4.

Figure 3D:
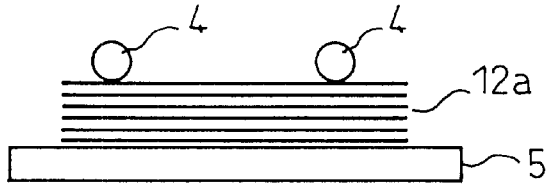
Figure 3E:
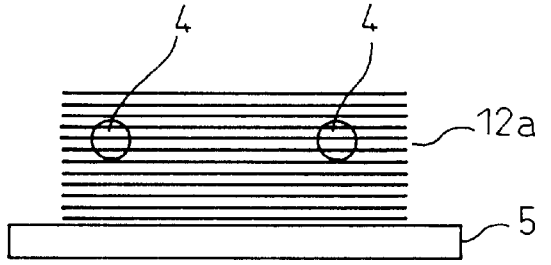
Figure 3F:
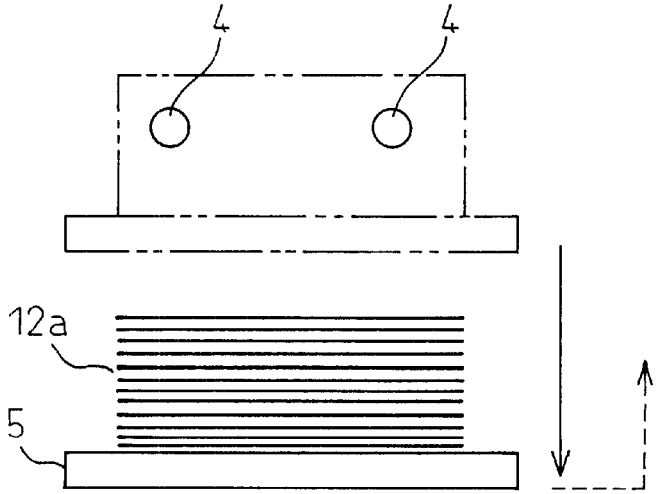

FIG. 3D illustrates a state where the paper table 5 that is once greatly lowered is raised again and is halted as the uppermost portion of the paper 12*a* is detected by the sensors 4. From this state until a predetermined period of time (e.g., time T4) passes, the operation continues for stacking the paper 12*a* on the paper table 5. FIG. 3E illustrates a state where the paper 12*a* is stacked in an increased amount on the paper table 5 after the elapse of time T4 from the state of FIG. 3D, and the sensors 4 are completely shaded by the paper 12*a*.

As the state shown in FIG. 3E is established after the elapse of time T4 from the state shown in FIG. 3D, the paper table 5 is greatly lowered due to the motor M1 and the belt 182 described with reference to FIG. 2A. Here, the distance the paper table 5 moves down is much larger than the height of the paper 12*a* stacked on the paper table 5 during the time T4. A two-dot chain line in FIG. 3F indicates the position of the paper table 5 of before it was lowered, and a solid line indicates the position of the paper table 5 after it is greatly lowered.

The paper table 5 is gradually raised from this position due to the motor M1 and the belt 182 described with reference to FIG. 2A. The paper table 5 ceases to rise when the uppermost portion of the paper 12*a* stacked on the paper table 5 is detected by the sensors 4. A two-dot chain line in FIG. 3G represents the position shown in FIG. 3D and solid line represents a position at which the paper table 5 has come into a halt at this time.

Figure 3G:
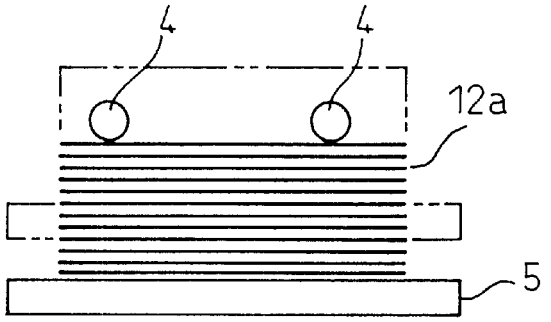

Thereafter, the paper table 5 stops at the position indicated by the solid line in FIG. 3G for only the time T4. During this moment, the paper 12*a* is stacked on the paper table 5. After the time T4 elapses, the paper table 5 is greatly lowered and is raised again, repetitively. The distance by which the paper table 5 is lowered after the elapse of the time T4 can be controlled to be a predetermined distance or to be the lowering of a predetermined time.

Figure 4:
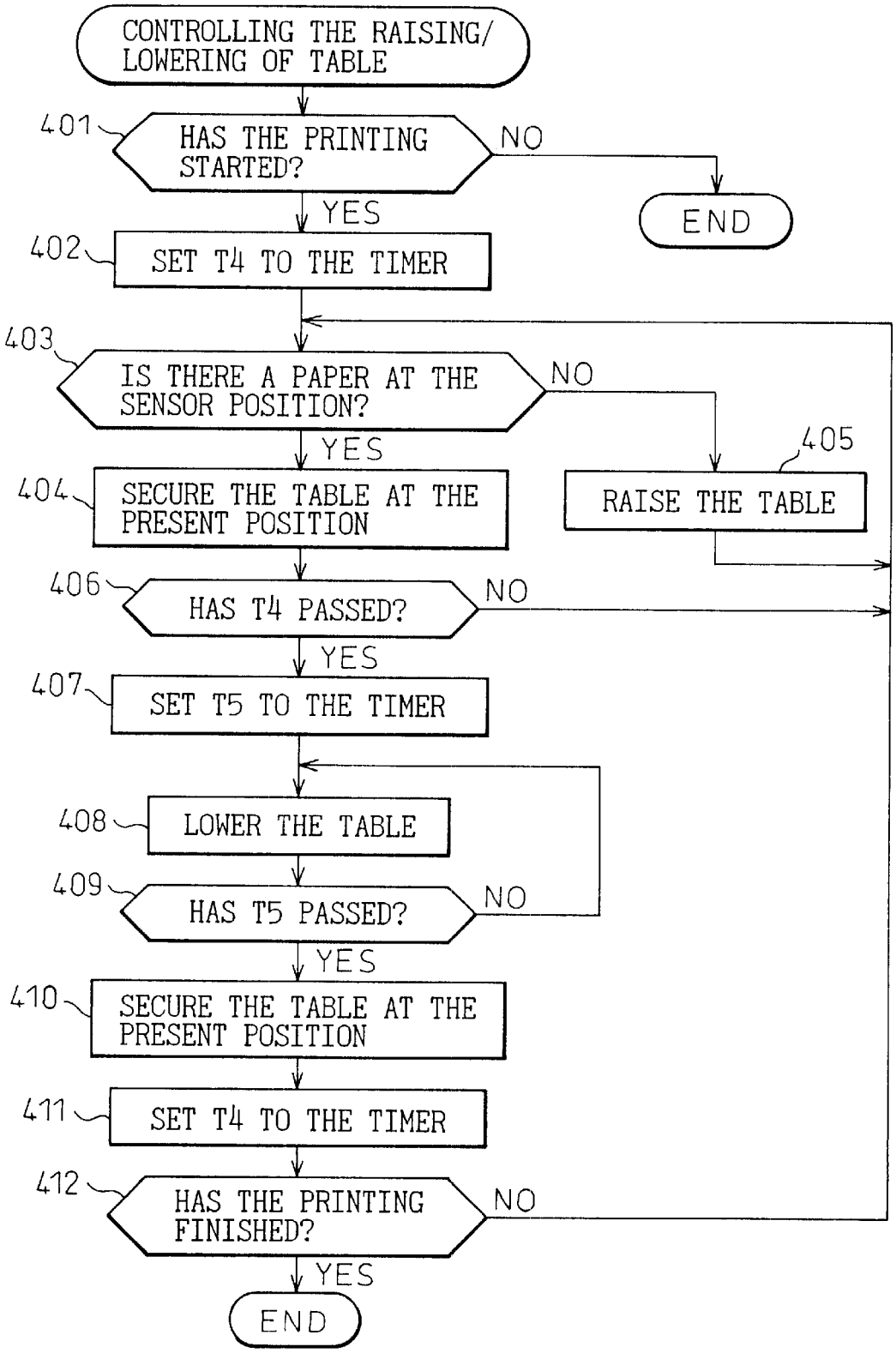
FIG. 4 is a flowchart illustrating the procedure of operation of the device for stacking the paper shown in FIGS. 3D to 3G.

FIG. 4 is a flowchart illustrating the procedure of operation for lowering and raising the paper table 5 shown in FIGS. 3D to 3G.

At step 401, it is judged whether the device 10 for printing the continuous paper has started printing. When it is not starting the printing, the routine ends. When it has started the printing, the routine proceeds to step 402 where the time T4 is set to the timer in the control unit 7 described with reference to FIG. 1B. The routine then proceeds to step 403. The time T4 is an interval in a cycle in which the paper table 5 stays lowered after the start of the printing. At step 403, whether the paper 12*a* exists at the sensor position is detected by the sensors 4 that detect the uppermost position of the paper 12*a* that is stacked as described with reference to FIG. 3A.

When there exists the paper 12*a* at the sensor position, the paper table 5 is secured at the present position at step 404. When there is no paper 12*a,* the routine proceeds to step 405 where the paper table 5 is raised, and the routine returns back to step 403. When the paper table 12*a* is fixed due to the processing at step 404, it is judged at step 406 whether the time T4 set to the timer has elapsed. When the time T4 has not elapsed, the routine returns back to step 403, and the operations of steps 403, 404 and 406 are repeated until the time T4 elapses.

When the time elapses after the start of the printing, the routine proceeds to step 407 where another time T5 is set to the timer, and the paper table 5 is lowered at next step 408. At next step 409, it is judged whether the time T5 set to the timer at step 407 has elapsed. When the time T5 has not elapsed, the routine returns back to step 408 where the paper table 5 continues to be lowered. When it is judged at step 409 that the time T5 has elapsed, the routine proceeds to step 410 where the paper table 5 is fixed at the present position. The procedure of step 407 through up to step 410 is to lower the paper table 5 by a predetermined distance.

As described above, after the paper table 5 is lowered by the time T5 from the elapse of the time T4, the paper table 5 is raised until the sensors 4 detect the uppermost portion of the paper. Hereinafter, the procedure is repeated to lower the paper table 5 by the time T5 after every elapse of the time T4. Accordingly, after the paper table 5 is fixed at step 410, i.e., after the paper table 5 ceases to be lowered, the time T4 until the start of lowering next time is set to the timer at step 411 and, then, the paper table 5 is raised. Step 412 next of step 411 is to judge whether the apparatus 10 for printing the continuous paper has finished the printing. When it is judged that the printing has been finished, the routine ends. When the printing has not been finished, the routine returns back to the step 403 to judge whether the paper is existing at the position of the sensors 4.

Right after the paper table 5 is lowered and is halted, the sensors 4 do not detect the uppermost portion of the paper 12*a* on the paper table 5. Therefore, the routine proceeds from step 403 to step 405 to raise the paper table 5. The paper table 5 continues to rise until the upper end of the paper 12*a* on the paper table 5 is detected by the sensors 4. At a moment when the sensors 4 have detected the upper end of the paper 12*a* on the paper table 5, the paper table 5 ceases to rise and is fixed at that position.

Thereafter, the operation is repeated in which the paper table 5 is lowered for the time T5 after every time T4 and, then, is raised until the upper end of the paper 12*a* is detected by the sensors 4. Thus, the paper table 5 is controlled in such a manner that the upper end of the paper 12*a* stacked thereon lies within the specified range at all times.

In swinging the swing guide 3 to fold the paper 12*a* along the perforation by swinging it toward the right and left, however, when the paper 12*a,* before being stacked on the paper table 5, shades the sensors 4 due to the swinging angle of the swing guide 3, there is established an unstable state where the sensors 4 temporarily and incorrectly judge that the paper exists. In this state, the paper table 5 often comes into a halt. This unstable state of the sensors 4 periodically occurs when the swing guide 3 is swinging.

That is, when the sensors 4 that detect the uppermost portion of the paper 12*a* assumes a state of producing an unstable output while the paper table 5 is rising, the rising operation of the paper table 5 is discontinued even when the paper table 5 is not really pushing the uppermost portion of the paper 12*a* up to the predetermined height. Thereafter, when the state where the sensors 4 produce unstable outputs is passed accompanying the motion of the swing guide 3, the sensors 4 normally detect the absence of paper, and the table rises again. According to the conventional control operation, therefore, the paper table manages to arrive at the predetermined height after having repeated the rising and stopping several times.

The operation of repeating the raising and stopping of the paper table 5 exerts a burden on the motor M1 for raising and lowering the table. Besides, the behavior when the paper table 5 is brought into a halt adversely affects the control operation for precisely raising or lowering the paper table 5 to maintain the uppermost portion of the paper 12*a* within the predetermined range.

Despite the paper table 5 being intermittently raised and lowered as described above, the speed of moving the paper 12*a* was not high and the performance of the motor M1 for raising and lowering the table could follow the rate of stacking the paper 12*a* on the paper table 5, making it possible to control the height of the paper table 5 to meet the practical use.

In recent years, however, the speed of moving the paper 12*a* is greatly increasing to meet the demand for executing the printing processing at high speed. At present, an 11-inch paper 12*a* is discharged and stacked at a rate of about 5 to 6 pieces a second, reckoned as A4-size. In the future, it is expected that the paper 12*a* will be discharged at a further increased speed, and the swinging speed of the swing guide 3 may further increase correspondingly. Therefore, if the sensors 4 for detecting the uppermost portion of the paper 12*a* periodically enter into a state of producing a normal output and a state of producing an unstable output, the stopping and raising of the paper table 5 are repeated at a high speed exerting an increased load on the motor M1 for raising and lowering the table. The motor M1 bearing the load becomes no longer capable of operating as instructed, such as raising or halting, and the stacked amount of the paper 12*a* often fails to reach the specified amount due to the repetition of raise and halt of the paper table 5.

To solve this problem, it can be contrived to use a motor M1 of high performance to increase the raising and lowering speed. This, however, causes the table drive mechanism to become very expensive. Besides, if the speed of raising or lowering the paper table 5 is simply increased, the motor M1 overruns to a large extent when the paper table 5 is brought into a halt to deteriorate the precision of height of the paper table 5.

In recent years, further, the printing has been executed in a variety of modes, such as printing a paper 12*a* on which a thick medium like a card has been stacked and printing a dense image on half of the paper 12*a*. Due to the kind of the paper 12*a* or due to deviated printing, therefore, the uppermost surface of the paper 12*a* stacked on the paper table 5 often becomes inclined in the right-and-left direction, causing such problems as defective stacking, damage to the paper, etc.

The present invention provides an apparatus for printing continuous paper and a device for stacking the paper capable of stacking, on the paper table 5, the paper 12*a* maintaining good precision without exerting a burden on the motor M1 for raising and lowering, by simply using a conventional mechanism and, hence, without greatly driving up the cost, featuring a simple constitution and lending itself well to high-speed processing.

Figure 5:
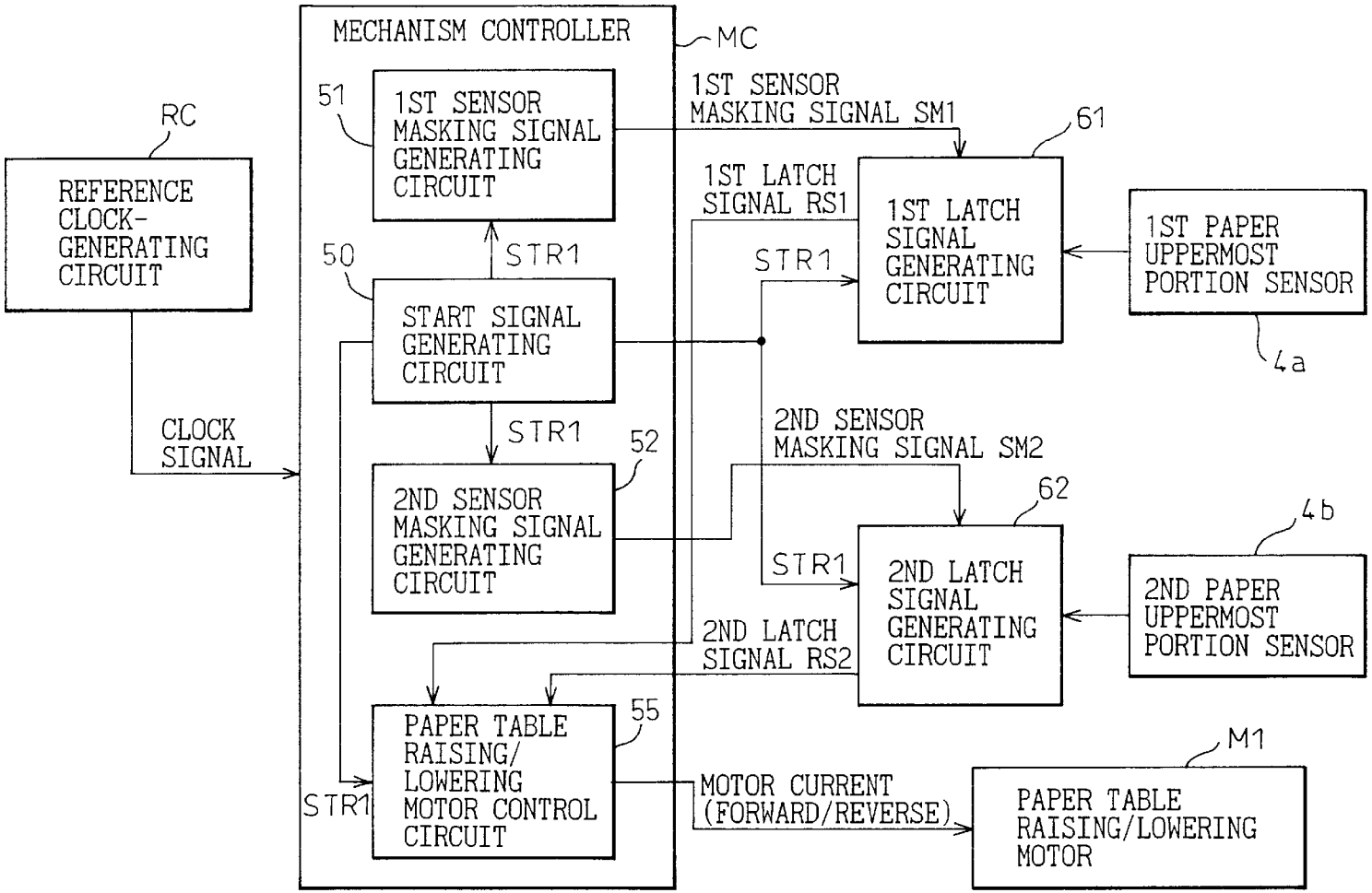
FIG. 5 is a block diagram of a control circuit for controlling the device for stacking the paper in the apparatus for printing the continuous paper according to the invention.

FIG. 5 is a block diagram illustrating in detail the constitution of a control unit in the apparatus for printing the continuous paper of the present invention, and also illustrates the constitution of part of the control unit 7 in the apparatus 10 for printing the continuous paper described with reference to FIG. 1B. The control unit 7 is for controlling the motor M1 for raising and lowering the paper table, and a mechanical unit is controlled by the control circuit and using the control program. The control unit 7 includes a reference clock-generating circuit RC, a mechanism controller MC, and first and second latch signal-generator circuits 61 and 62. The first latch signal-generating circuit 61 receives a detection output from the first sensor 4*a* that detects the uppermost portion of the paper, and the second latch signal-generating circuit 62 receives a detection output from the second sensor 4*b* that detects the uppermost portion of the paper.

The mechanism controller MC1 includes a start signal-generating circuit 50, first and second sensor masking signal-generating circuits 51 and 52 that receive a start signal STR1 from the start signal-generating circuit 50, and a motor control circuit 55 for raising and lowering the paper table. The mechanism controller MC1 receives clock signals from the reference clock-generating circuit RC. The start signal STR1 of the start signal-generating circuit 50 is further fed to the first and second latch signal-generating circuits 61 and 62 outside the mechanism controller MC.

The first and second sensor masking signal-generating circuits 51 and 52 in the mechanism controller MC1 produce first and second sensor masking signals SM1 and SM2 representing timing in which the uppermost portion detector means produces an unstable output, which are sent to the first and second latch signal-generating circuits 61 and 62. The start signal-generating circuit 50 produces a start signal STR1 that represents that the paper is being moved. That is, the start signal STR1 is turned on when the paper is being moved and is turned off when the paper is not being moved. FIG. 5 illustrates the case of when there are provided the first and second uppermost portion sensors 4*a* and 4*b* which are the two uppermost detector means. Accordingly, there are provided the first and second sensor masking signal-generating circuits 51 and 52.

In response to the input of start signal STR1 and sensor masking signals SM1, SM2, the first and second latch signal-generating circuits 61 and 62 produce first and second latch signals RS1 and RS2 corresponding thereto. The latch signals RS1 and RS2 produced by the first and second latch signal-generating circuits 61 and 62, are input again to means 55 for controlling the motor for raising and lowering the paper table in the mechanism controller MC1. Details of the latch signal-generating means 53 and 54 will be described with reference to FIG. 6, and details of the circuit 55 for controlling the motor for raising and lowering the paper table will be described with reference to FIG. 11.

Figure 6:
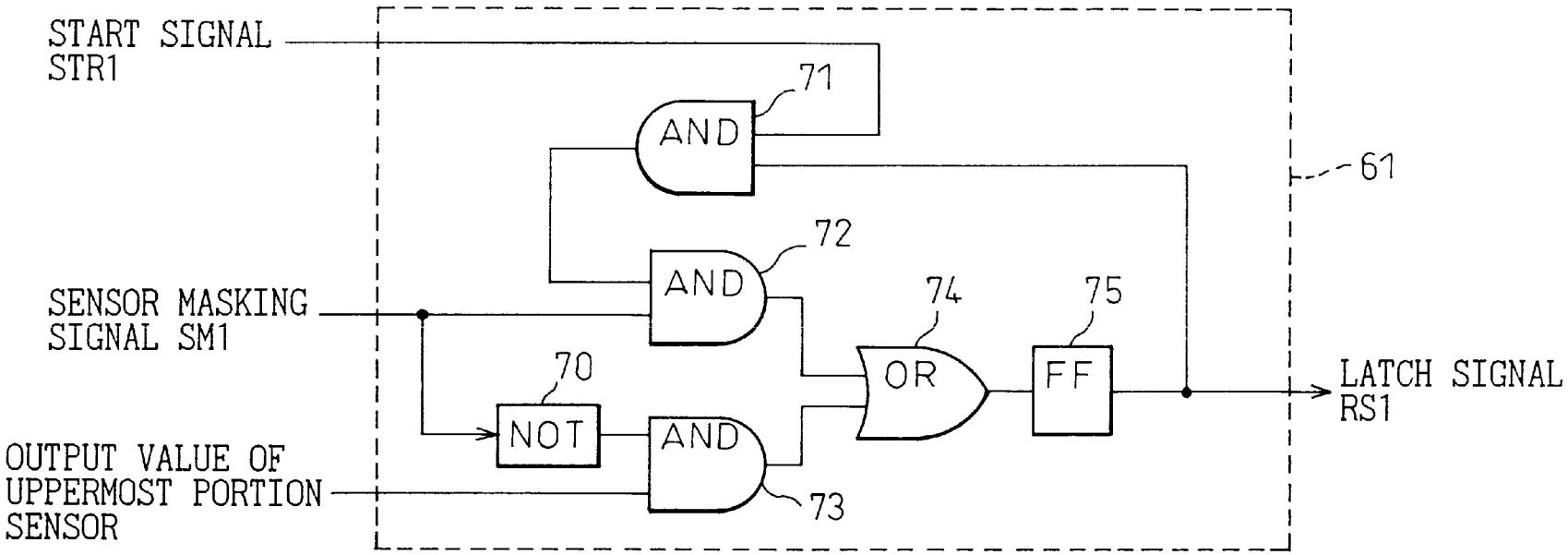
FIG. 6 is a diagram illustrating the constitution of a latch signal-generating circuit shown in FIG. 5.

FIG. 6 is a circuit diagram illustrating, in detail, the constitution of the first latch signal-generating circuit 61 shown in FIG. 5. The constitution of the second latch signal-generating circuit 62 shown in FIG. 5 is quite the same as the constitution of the first latch signal-generating circuit 61. Accordingly, described below are the constitution and operation of the first latch signal-generating circuit 61, but the constitution and the operation of the second latch signal-generating circuit 62 are not described.

The first latch signal-generating circuit 61 is constituted by a NOT circuit 70, three AND circuits 71, 72, 73, an OR circuit 74, and a flip-flop (FF) circuit 75. The AND circuit 71 receives the start signal STR1 and latch signal RS1, the AND circuit 72 receives the sensor masking signal SM1 and an output from the AND circuit 71, and the AND circuit 73 receives an output value from the uppermost portion sensor 4 and the sensor masking signal SM1 of which the positive or negative polarity is inverted through the NOT circuit 70. The OR circuit 74 receives outputs from the AND circuits 72 and 73, and an output of the OR circuit 74 serves as the latch signal RS1 through the FF circuit 75.

Figure 7:
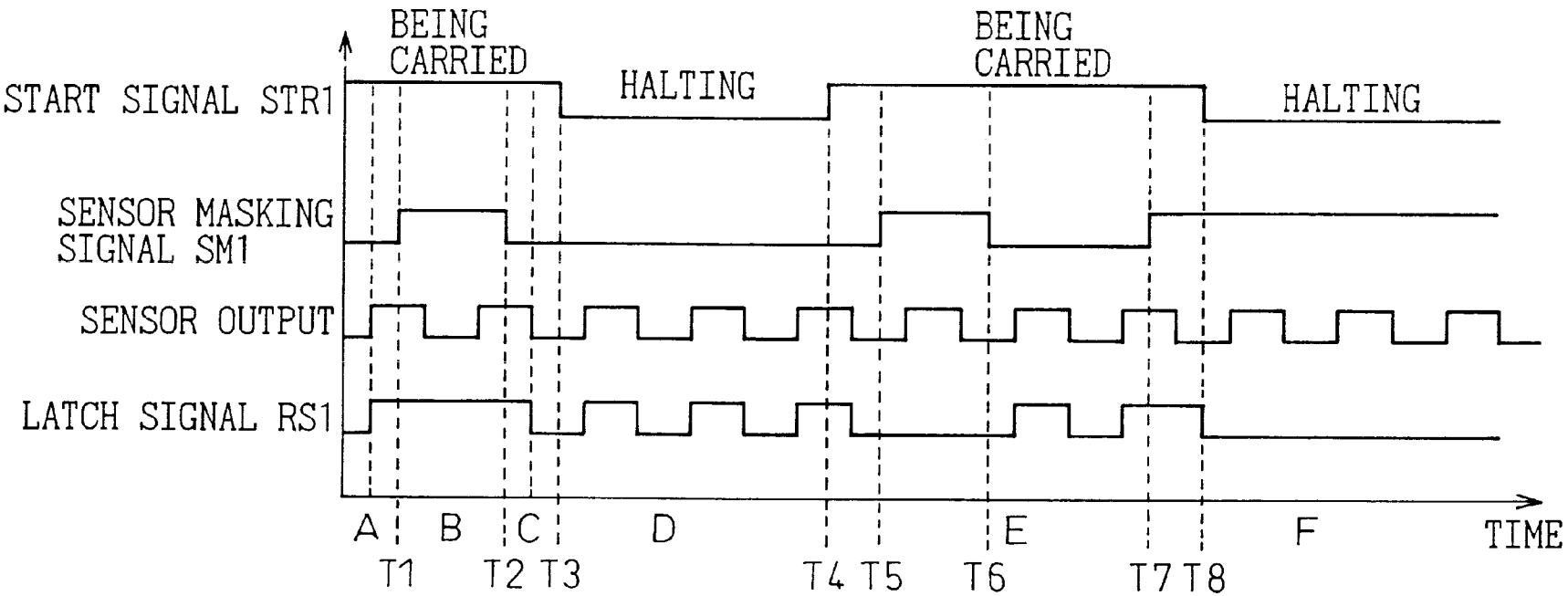
FIG. 7 is a diagram of waveforms illustrating the operation of the latch signal-generating circuit shown in FIG. 5 with the lapse of time.

FIG. 7 illustrates the operation of the first latch signal-generating circuit 61. The start signal STR1 is turned off at a time T3, on at a time T4 and off at a time T8. In a state where the start signal STR1 is on and the sensor masking signal SM1 is off (times A, C), the output value of the uppermost portion sensor 4 is produced as the latch signal RS1. When the sensor masking signal SM1 is turned on at a time T1 in a state where the start signal STR1 is on, the preceding output value of the sensor 4 is stabilized through the FF circuit 75 and is held as the latch signal RS1. So far as the sensor masking signal SM1 remains turned on, the latch signal RS1 remains unchanged (time B) irrespective of the output value of the sensor 4. The sensor masking signal SM1 is turned off at a time T2.

When the start signal STR1 is turned off and the sensor masking signal SM1 is turned off (time D), the output value of the sensor 4 is just produced as the latch signal RS1 as during the printing. In a state where the start signal STR1 is turned off and the sensor masking signal SM1 is turned on (time F), the latch signal RS1 is produced as an off signal representing the no-paper state irrespective of the preceding output value of the sensor 4. This is because, the paper table 5 may often be raised or lowered by hand while the printing is being halted. At this moment, if the latch signal RS1 is maintained in a set state, the paper table 4 is not normally raised though its real position is low. In order to avoid this occurrence, the latch signal RS1 is produced as an off signal.

Figure 8:
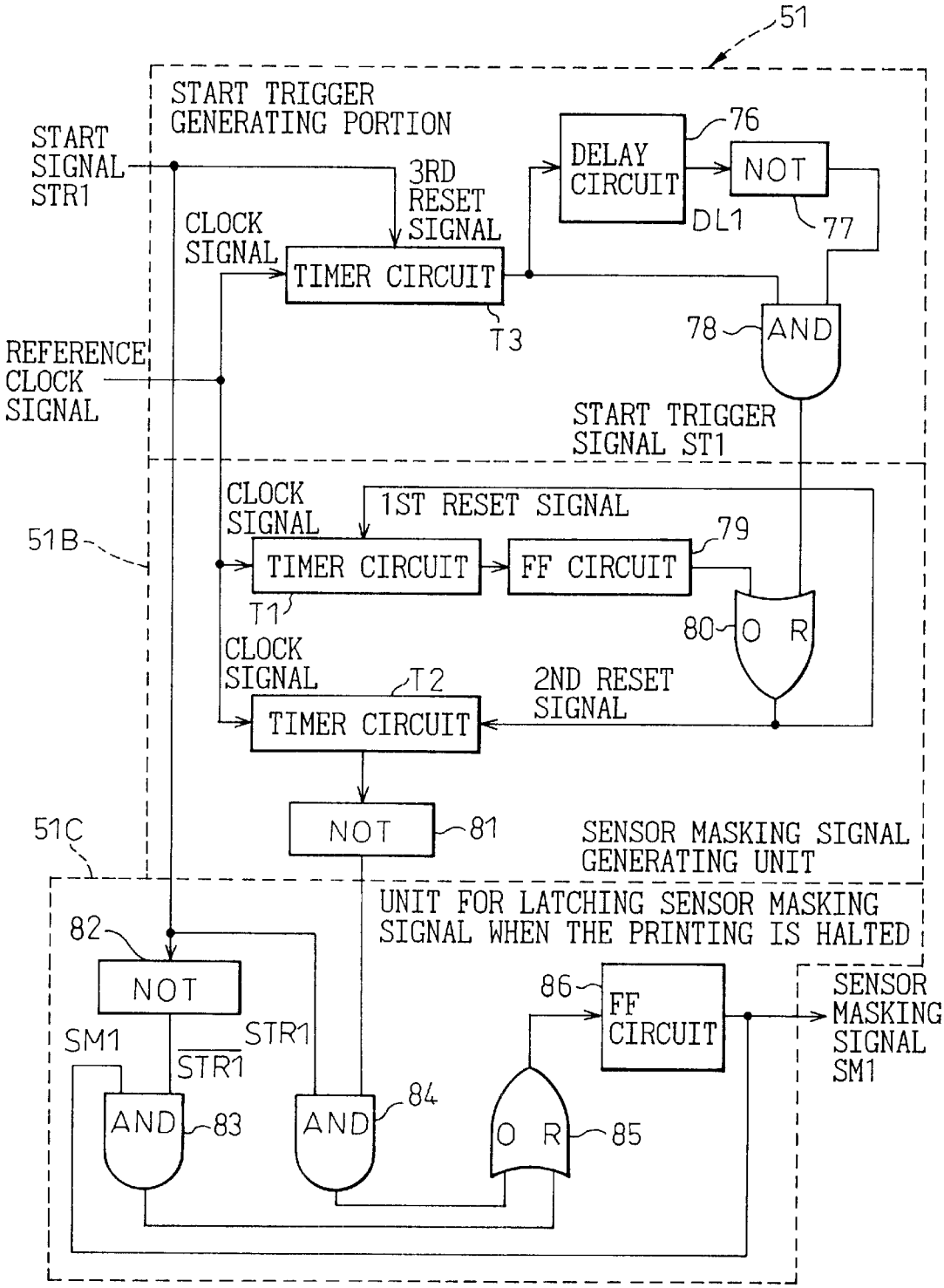
FIG. 8 is a diagram illustrating the constitution of a masking signal-generating circuit and of the peripheral circuit shown in FIG. 5.

FIG. 8 is a block diagram illustrating, in detail, the constitution of the first sensor masking signal-generating circuit 51. The constitution of the second sensor masking signal-generating circuit 52 shown in FIG. 5 is quite the same as the constitution of the first sensor masking signal-generating circuit 51. Therefore, described below are the constitution and operation of the first sensor masking signal-generating circuit 51, but the constitution and the operation of the second sensor masking signal-generating circuit 52 are not described.

The first sensor masking signal-generating circuit 51 is constituted by a start trigger-generating unit 51A, a sensor masking signal-generating unit 51B, and a sensor masking signal-latching unit 51C for latching when the printing is halted. The start trigger-generating unit 51A includes a timer circuit T3, a delay circuit 76, a NOT circuit 77 and an AND circuit 78. The sensor masking signal-generating unit 51B includes two timer circuits T1 and T2, an FF circuit 79, an OR circuit 80 and a NOT circuit 81. The sensor masking signal-latching unit 51C for latching when the printing is halted includes a NOT circuit 82, two AND circuits 83 and 84, an OR circuit 85 and an FF circuit 86.

The start signal STR1 is input to the timer circuit T3 in the start trigger-generating unit 51A, to the AND circuit 83 through the NOT circuit 82 in the sensor masking signal-latching unit 51C for latching when the printing is halted, and to the AND circuit 84. The output of the timer circuit T3 is input to the delay circuit 76 and to the AND circuit 78, and another input of the AND circuit 78 receives the output of the delay circuit 76 through the NOT circuit 77. The output of the timer circuit T1 is input to the OR circuit 80 through the FF circuit 79. Another input of the OR circuit 80 receives an output of the AND circuit 78 in the start trigger-generating unit 51A. The outputs of the OR circuit 80 are sent as first and second reset signals to the timer circuit T1 and to the timer circuit T2, and the output of the timer circuit T2 is input to the AND circuit 84 in the sensor masking signal-latching unit 51C for latching when the printing is halted through the NOT circuit 81.

Outputs of the two AND circuits 83 and 84 in the sensor masking signal-latching unit 51C for latching when the printing is halted, are sent to the FF circuit 86 through the OR circuit 85. The FF circuit 86, then, produces the sensor masking signal SM1. The sensor masking signal SM1 is further sent to another input of the AND circuit 83.

Figure 9:
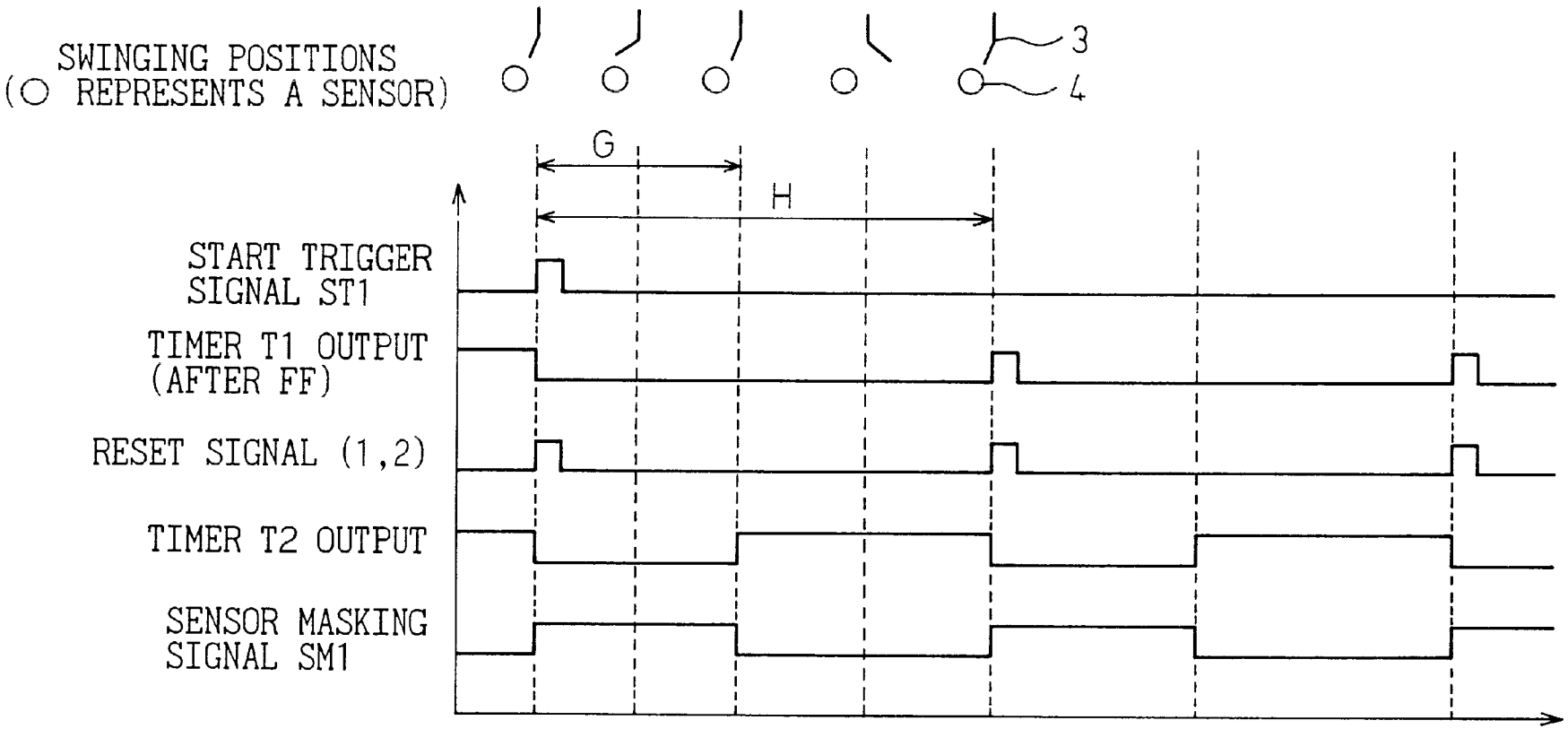
FIG. 9 is a diagram of waveforms illustrating the operation of a sensor masking signal-generating circuit shown in FIG. 8 in relation to the swinging position of the paper-sorting device and the paper sensor with the lapse of time.

FIG. 9 is a timing chart illustrating changes in the start trigger signal ST1 in the first sensor masking signal-generating circuit 51 constituted as shown in FIG. 8, in the output signal of the timer circuit T1 through the FF circuit 79, in the first and second reset signals, in the output of the timer circuit T2 and in the sensor masking signal SM1 with the passage of time. A relationship between the swing guide 3 and the sensors 4, for sensing the uppermost portion of the paper, is also shown together with the timing chart.

The start trigger signal ST1 is a pulse signal that is generated behind the start signal STR1 that represents the real start of printing by a time set to the timer circuit T3, i.e., behind by a difference of the initial position of the swing guide 3 due to the data related to the length of the paper and the folding perforation such as mountain perforation and valley perforation. The data set to the timer circuit T3 have already been written as table in a ROM (not shown) in the mechanism controller MC. FIG. 17 illustrates table data in the ROM. The table stores the length of the paper 12*a* and the position of the swing guide 3, i.e., time determined depending upon whether it is on the side of the mountain perforation or the valley perforation.

The sensor masking signal SM1 is produced by the control unit in a manner of being turned on and off depending upon the positional relationship between the swing guide 3 and the paper uppermost portion sensors 4. However, since the position of the swing guide 3 has been exclusively determined, the sensor masking signal SM1 can be produced by detecting the position of the swing guide 3, but is produced by controlling the time from the start of printing.

That is, the sensor masking signal SM1 is produced from the start trigger signal ST1 by rectangular waves formed by the timer circuits T1 and T2. Here, a time required the swing guide 3 to make a round trip (section H in FIG. 9) has been set to the timer circuit T1, and a time for shading the paper uppermost portion sensor 4 due to the position of the swing guide 3 (section G in FIG. 9) has been set to the timer T2.

The times set to the timer circuits T1 and T2 are selected by the mechanical control unit after the paper size has been determined, since the swinging period of the swing guide 3 differs depending upon the size of the paper. The times can be further set by reading the data that have been stored in advance as table data in the ROM like that of the timer circuit T3.

Figure 10:
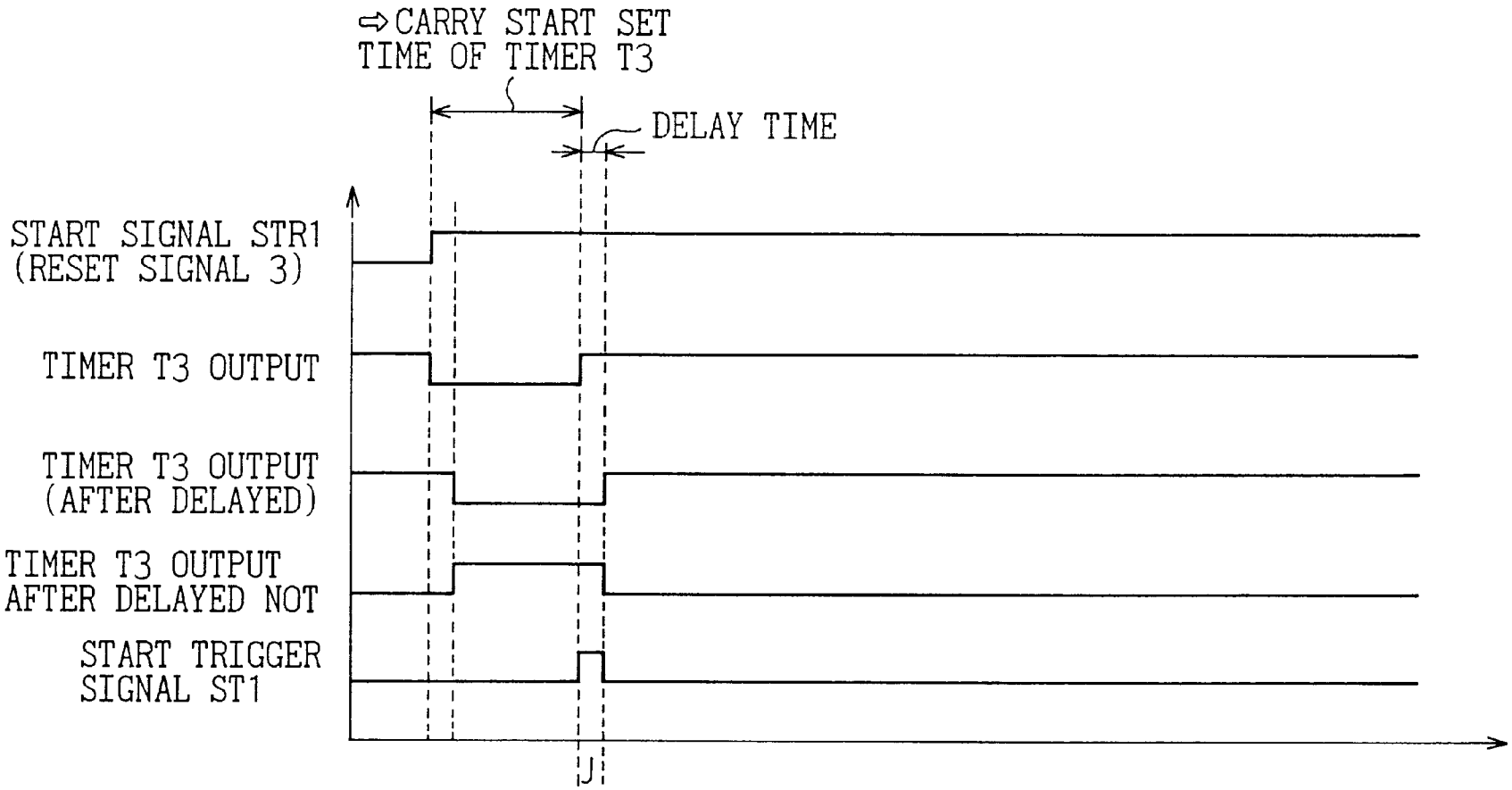
FIG. 10 is a diagram of waveforms illustrating the operation of a start trigger signal-generating circuit shown in FIG. 8 with the lapse of time.

FIG. 10 illustrates the operation of the start trigger signal-generating unit 51A. The pulse width (denoted by a sign J in FIG. 10) of the start trigger signal ST1 has been determined to be generated only during the delay period DL1 set by the delay circuit 76 in the start trigger signal-generating unit 51A.

Figure 11:
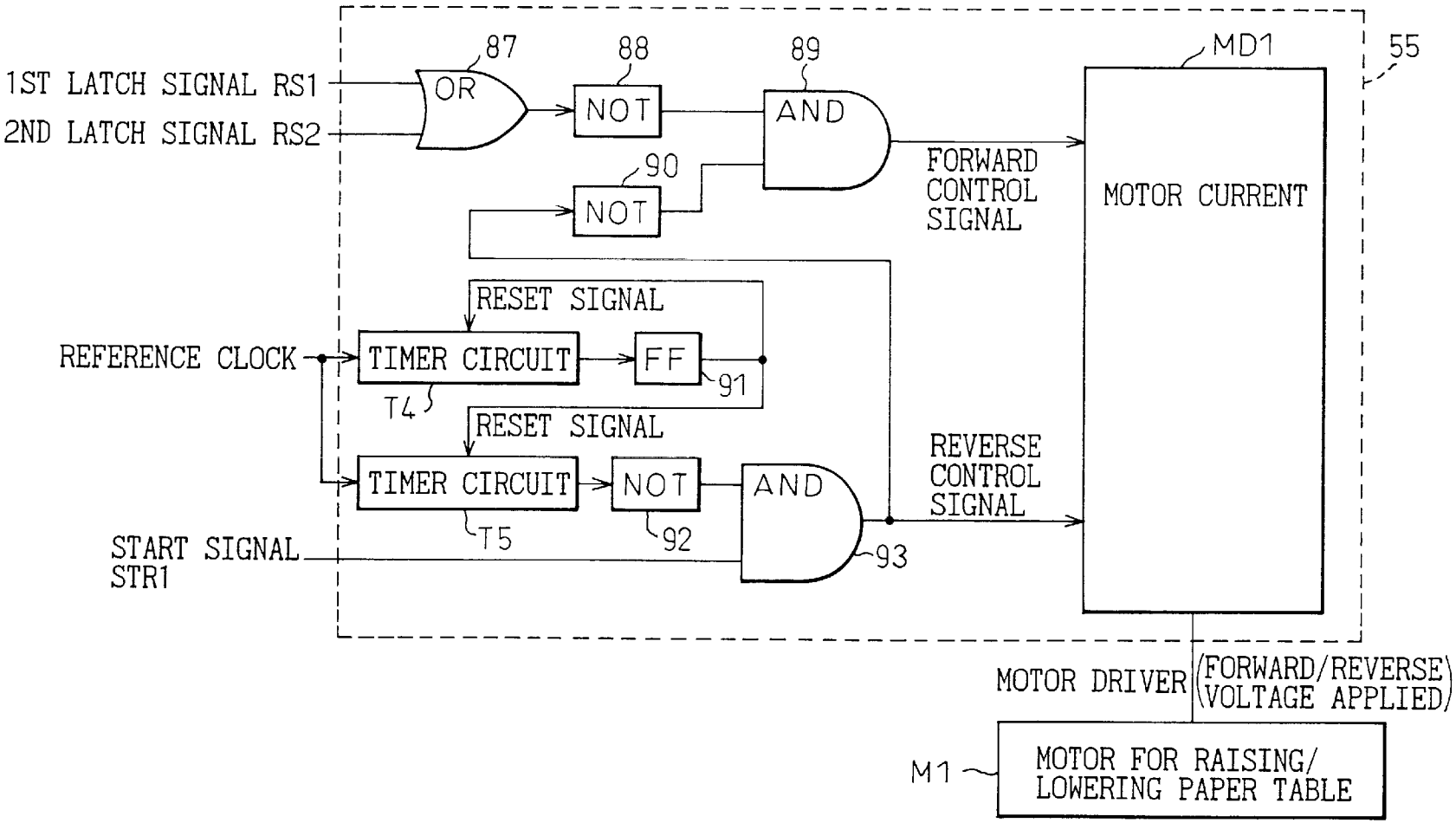
FIG. 11 is a diagram illustrating the constitution of a circuit for controlling the motor for raising and lowering the paper table shown in FIG. 5.

FIG. 11 is a block diagram illustrating, in detail, the constitution of the circuit 55 for controlling the motor for raising and lowering the paper table shown in FIG. 5. The OR circuit 87 receives the first and second latch signals RS1 and RS2 formed by the first and second latch signal-generating circuits 61 and 62. The output of the OR circuit 87 is sent to the AND circuit 89 through the NOT circuit 88. Reference clocks are input to the timer circuits T4 and T5. The output of the timer circuit T4 is input to the FF circuit 91 and, then, is output as a reset signal which is fed to the timer circuits T4 and T5. The AND circuit 93 receives the output from the timer circuit T5 through the NOT circuit 92 and the start signal STR1, and produces an output which is fed as a reversed control signal to the motor driver MD1. The reversed control signal is reversed through the NOT circuit 90, fed to the AND circuit 89, and the output of the AND circuit 89 is fed as a forward control signal to the motor driver MD1. The output of the motor driver MD1 is input as a motor current of a forward voltage or a reverse voltage to the motor M1 for raising and lowering the paper table.

Figure 12:
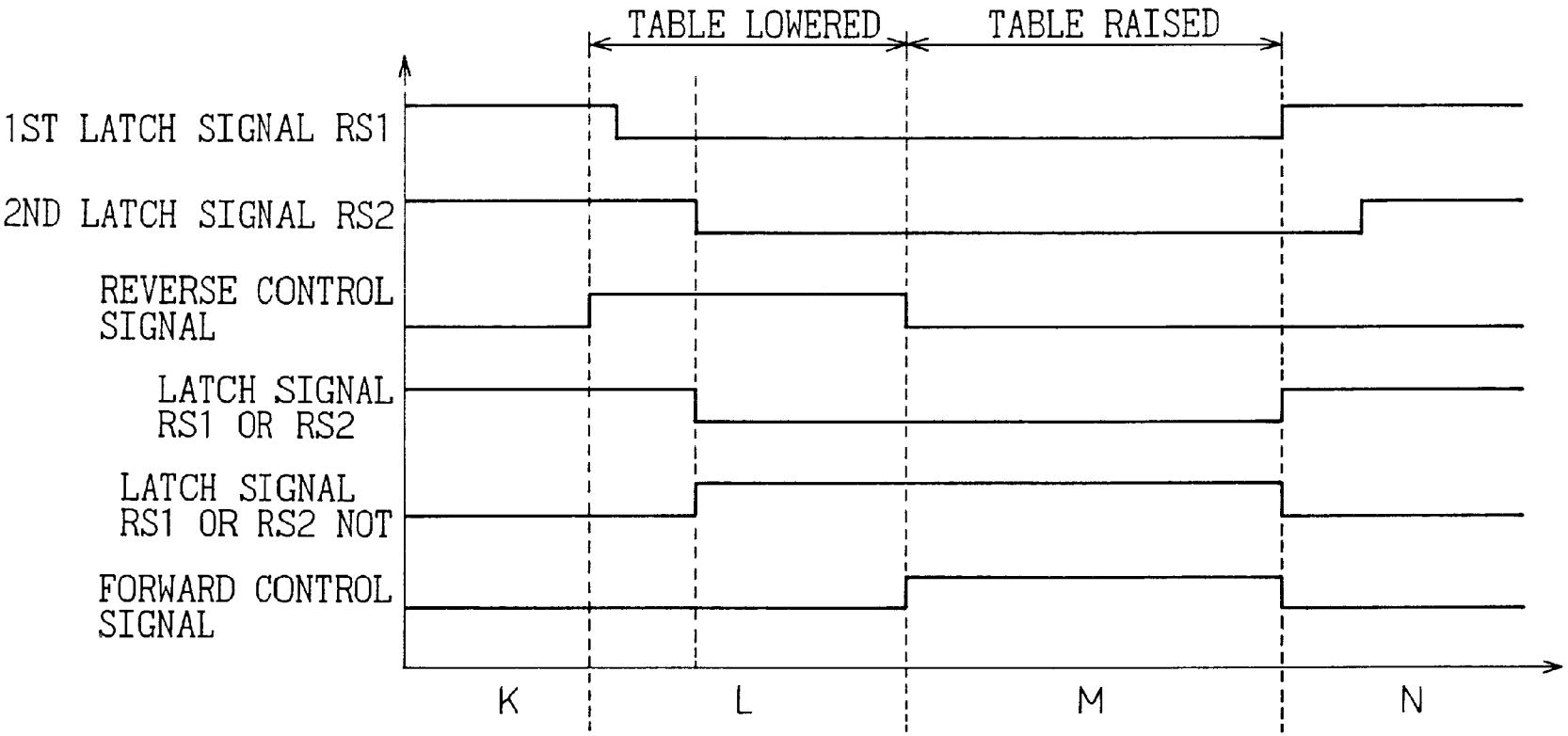
FIG. 12 is a diagram of waveforms illustrating the forward-operation-signal for the raising and lowering motor for the paper table shown in FIG. 11 with the lapse of time.
Figure 13:
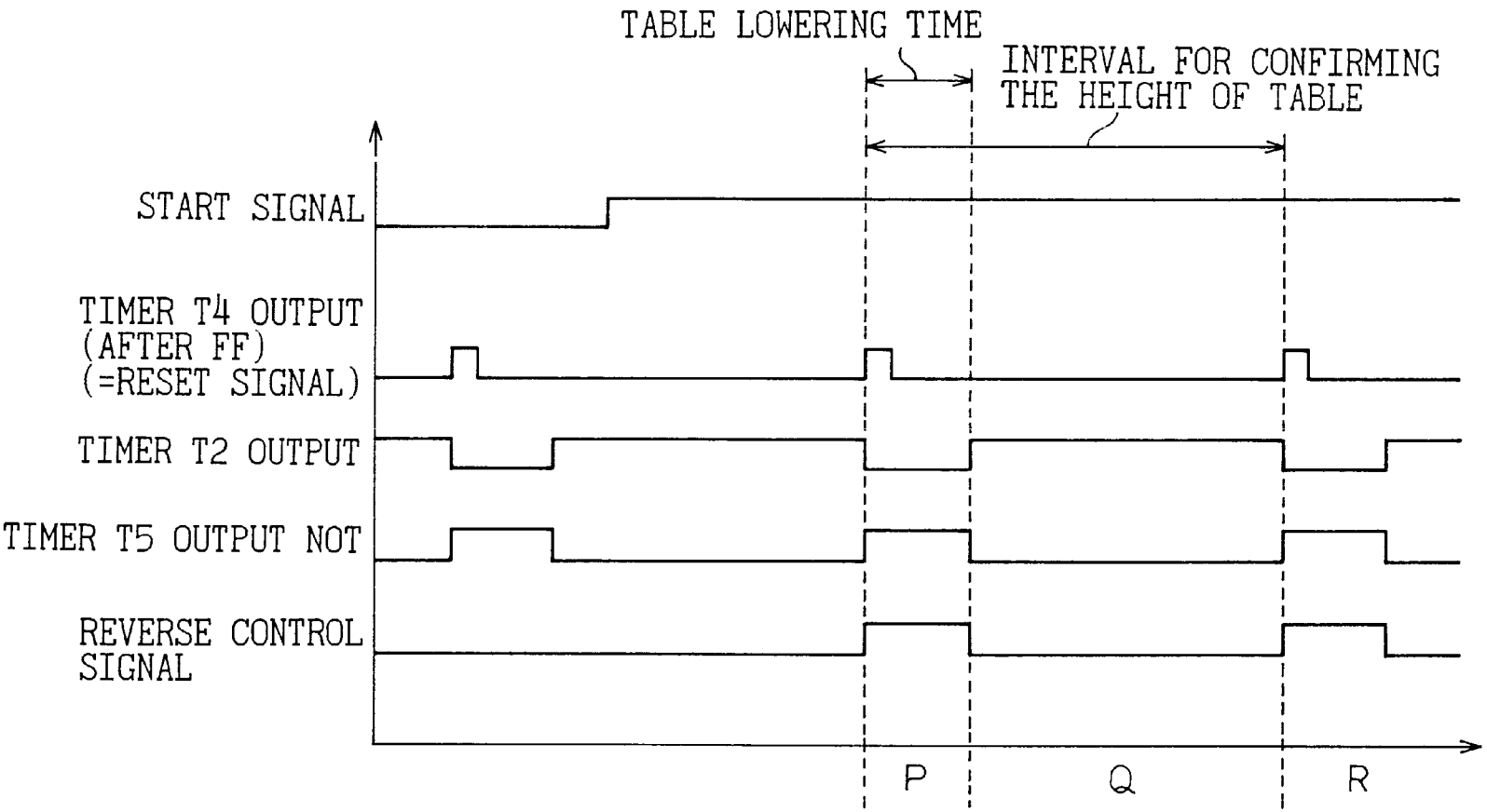
FIG. 13 is a diagram of waveforms illustrating the backward-operation-signal for the raising and lowering motor for the paper table with the lapse of time.

FIG. 12 is a timing chart of when the motor M1 for raising and lowering the paper table is rotating forward, and FIG. 13 is a timing chart of when the motor M1 for raising and lowering the paper table is rotating backward.

As described above, the motor driver MD1 receives a forward control signal and a reverse control signal, and applies a predetermined voltage of forward or reverse polarity to the motor M1 for raising and lowering the paper table when these control signals are turned on.

Described below is a case where a DC motor is used as the motor M1 for raising and lowering the paper table and is driven being controlled by a predetermined voltage. The motor M1 for raising and lowering the paper table is rotated forward or reverse by reversing the polarity of the driving current; i.e., the paper table is raised when the motor M1 rotates forward and is lowered when the motor M1 rotates reverse. The timer circuit T4 described with reference to FIG. 11 is for counting the time in which the table is lowered, and the timer circuit T5 is for counting the time for lowering the paper table.

When the latch signals RS1 and RS2 are both in the no-paper state, i.e., off (section represented by a sign M in FIG. 12) during the printing operation, the forward control signal is input to the motor driver MD1 and the table is raised due to the forward rotation voltage produced from the motor driver MD1. When either the latch signal RS1 or the latch signal RS2 is on, or when both of them are on representing the paper-is-existing state, the forward control signal input to the motor driver MD1 is turned off irrespective of the start signal STR1 or the timer circuits T4, T5.

When the timer circuit T4 has counted up the time in which the table is lowered in a state where the start signal STR1 is turned on during the printing operation, the timer circuit T5 is reset to start the counting (section P shown in FIG. 13). In the timer circuit T5 has been set the time for lowering the paper table. When the timer circuit T5 is counting the time, the output of the timer circuit T5 which is in the off state is reversed by the NOT circuit 92 and is input to the AND circuit 93. Accordingly, the reverse control signal is produced from the AND circuit 93, and the paper table is lowered. When the timer circuit T5 starts counting, the timer circuit T4 starts counting again the time until the next lowering. When the timer circuit T5 counts up, the output of the timer circuit T5 is in the on state, whereby the reverse control signal is turned off and the paper table stops lowering (section Q in FIG. 13).

The reverse control signal is also input to the forward control signal-forming unit (AND circuit 89) being reversed through the NOT circuit 90, and turns the AND circuit 89 off when the reverse control signal is on. Therefore, the forward control signal is turned off irrespective of the latch signal RS1, RS2. Even if it happens that the forward and reverse control signals are turned on simultaneously, the reverse control signal takes precedence, i.e., precedence is given to lowering the paper table (section L in FIG. 12).

Figure 16:
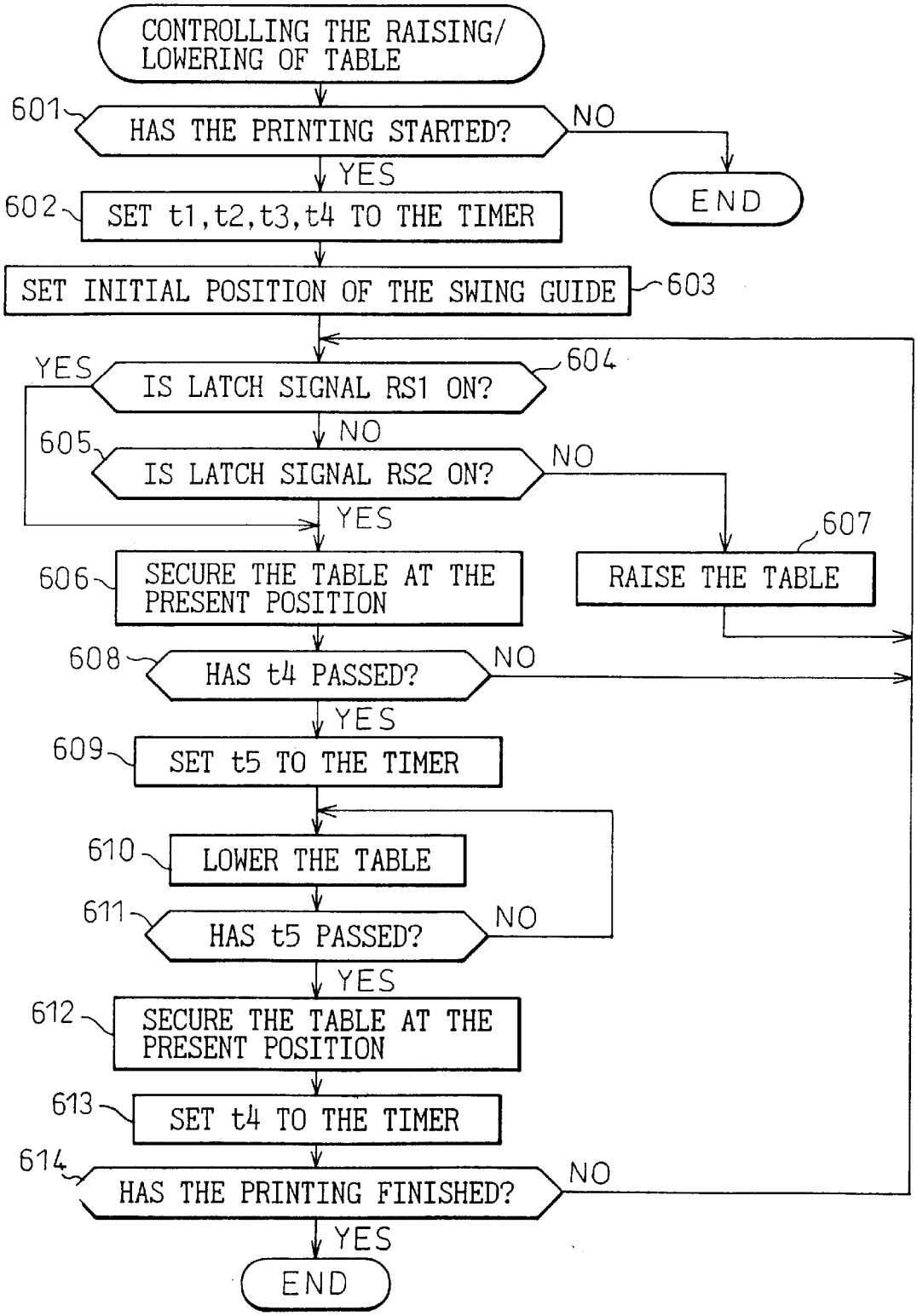
FIG. 16 is a flowchart illustrating the procedure for raising and lowering the paper table according to the present invention.

Next, described below with reference to a flowchart of FIG. 16 is the operation for controlling the rising and lowering of the paper table according to a program by using the mechanism controller MC1 of the present invention.

Steps 601 through 603 are for initial setting at the start of printing. It is judged at step 601 whether the printing is started. When the printing is started, the routine proceeds to step 602. When the printing is started, the data of paper length must be determined. At step 602, therefore, a time t1 required by the swing guide 3 to make a round trip is set to the timer circuit T1, a time T2 for shading the paper uppermost portion sensing means due to the position of the swing guide 3 is set to the timer circuit T2, a time t3 from the start of printing until the generation of a start trigger signal is set to the timer circuit T3, and a time t4 for checking the lowering of the paper table is set to the timer circuit T4. At step 603, further, the swing guide 3 which is a paper-folding mechanism is set to the initial position.

Thereafter, the height of the table is so controlled that the uppermost portion of the paper is at a specified position as shown in steps 604 to 607.

At step 604, first, it is checked whether the latch signal RS1 has been turned on. When it has been turned on, it is judged that the paper table 5 is at the specified position, and the operation for raising or lowering the paper table 5 is discontinued at step 606, and the paper table 5 is secured at the present position. When the latch signal RS1 has not been turned on, the routine proceeds to step 605 to check the latch signal RS2. When the latch signal RS2 has been turned on, it is judged that the paper table 5 is at the specified position, and the operation for raising or lowering the paper table 5 is discontinued at step 606, and the paper table 5 is secured at the present position.

When both of the latch signals RS1 and RS2 have not been turned on at steps 604 and 605, it is not possible to detect the uppermost portion of the paper. It is therefore so judged that the paper table 5 is lower than the specified position, and the paper table 5 is raised at step 607. When the latch signal RS1 has not been turned on but the latch signal RS2 has been turned on, it is judged that the paper table 5 is at the specified position, and the paper table 5 is halted and is secured at the present position at step 606. Here, the latch signal that has been turned on stands for a state where the uppermost portion sensor 4 has detected the presence of the paper, and the latch signal that has not been turned on stands for a state where the uppermost portion sensor 4 is not detecting the paper.

In the state where the latch signals RS1 and RS2 are turned on at all times, i.e., where one or both of the uppermost portion sensors 4 are detecting the presence of the paper, the paper 12*a* continues to be stacked on the paper table 5 and reaches the swinging range of the swing guide 3 in due course. It therefore becomes necessary to once lower the paper table 5 after every time t4 set by the timer circuit T4.

This operation is shown from step 608 through step 613. When the paper table 5 is halting in a state where either the latch signal RS1 or the latch signal RS2 is turned on, it is judged at step 608 whether the time t4 set by the timer circuit T4 is counted up.

After the timer circuit T4 has counted up the time t4, the paper table 5 is lowered for only a specified time t5.

The time t5 for lowering the paper table 5 is set to the timer circuit T5 at step 609, and the paper table 5 is lowered at step 610 until the time t5 set to the timer circuit T5 is counted up. In order to lower the paper table T5 for only the specified time t5 set to the timer circuit T5, it is judged at step 611 whether the timer circuit T5 has counted up the time t5. The routine returns back to step 610 so that the paper table 5 continues to be lowered until the timer circuit T5 counts up the time t5. After the timer circuit T5 has counted up the time t5, the paper table ceases to lower at step 612 and is secured at that position. At subsequent step 613, the time t4 is set again to the timer circuit T4 to count the time t4 which is an interval until the next lowering. It is then judged at step 614 whether the printing is finished. When the printing has not been finished, the routine returns back to step 604 to raise the paper table T5 again so that the uppermost portion of the paper lies within the specified range.

The above-mentioned operation is such that the time for generating the sensor masking signal is determined depending upon the standby position of the swing guide 3 at the start of the printing. Therefore, required timer values are also set nearly simultaneously with the setting of the swing guide at the standby position in order to start the control operation from the start of printing irrespective of the state of when the operation is brought into a halt. Therefore, even when the start of printing and the stop of printing are repeated, the sensor masking signal is correctly generated relying upon the position of the swing guide 3. The operation for raising and lowering the paper table is controlled by utilizing the sensor masking signal and, hence, the positional relationship between the uppermost portion of the stacked paper and the swing guide 3 is maintained constant at all times.

Figure 14:
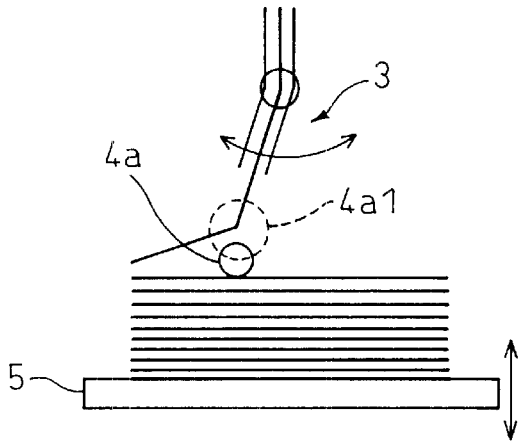
FIG. 14 is a view illustrating the constitution of a conventional paper table.
Figure 15:
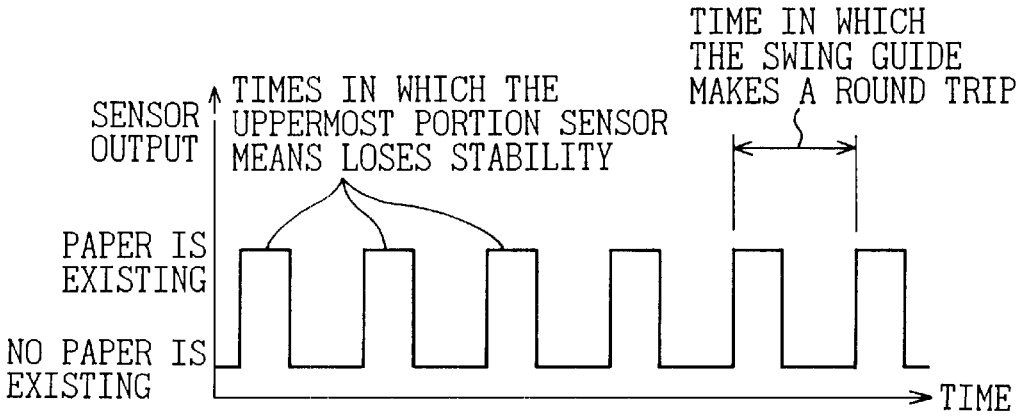
FIG. 15 is a diagram of waveforms illustrating a relationship between the conventional paper table and the detection signal.

According to the prior art, the uppermost portion sensor detects the uppermost portion of the paper after the paper table 5 is lowered and, then, the paper table 5 is raised so that the uppermost portion of the stacked paper lies within the specified range. In this case, there occurs a state in which the light-receiving element 4*a*1 of the uppermost portion sensor is shaded by the paper 12*a* due to the position of the swing guide 3 that is swinging as shown in FIGS. 14 and 15 within a time in which the swing guide 3 makes a round trip. According to the present invention, the timing for halting the paper table 5 is determined based upon the latch signals RS1 and RS2 generated by the first and second latch signal-generating circuits 61 and 62 described with reference to FIG. 6, eliminating the need of checking the output of the uppermost portion sensor 4*a*1 in an unstable state.

FIG. 18 is a view of an ideal state for halting the paper table 5 of when the uppermost portion of the paper is deviated aslant, and FIG. 19 is a view illustrating a state where the paper table 5 is too high and the paper may be damaged by the swing guide 3.

In this case, too, the sensor 4 is alternatingly shaded by the paper 12*a* of before being stacked depending upon the position of the swing guide 3. According to the present invention, therefore, either the latch signal RS1 or the latch signal RS2 of the paper uppermost portion sensors 4*a* and 4*b* is checked, and the operation for raising the paper table 5 is discontinued at a moment when the uppermost portion of the paper 12*a* is detected by either the latch signal RS1 or the latch signal RS2.

Figure 20:
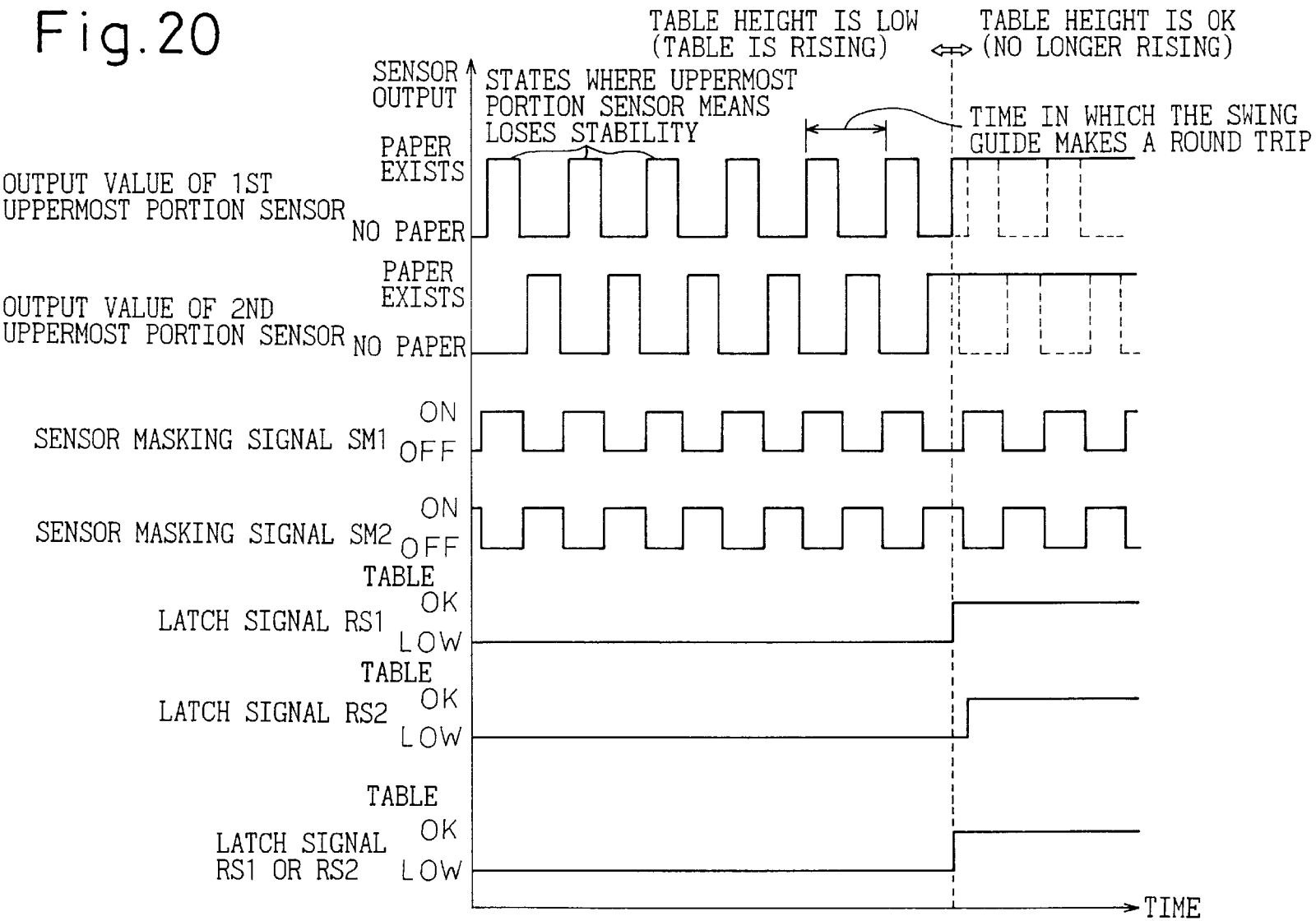
FIG. 20 is a timing chart for judging the latch signals according to the present invention.

FIG. 20 is a time chart illustrating the operation of when there are provided plural sensors 4 (two sensors in this embodiment) according to the embodiment of the present invention.

Light falling on the light-receiving portions of the first and second uppermost portion sensors 4 facing the swing guide 3 that swings, is alternatingly shaded as the paper of before being stacked swings together with the swing guide 3. Therefore, the presence or absence of the uppermost portion of the paper 12*a* is alternatingly detected to produce an output.

The sensor masking signals SM1 and SM2 are produced for the first and second uppermost portion sensors 4 in a manner contrary to the above. As shown in FIG. 6, therefore, the latch signals RS1 are set by an output value of outside the sensor-masking period. According to the present invention, further, the final time of when the paper table 5 has come into a halt is judged relying upon one or more latch signals, i.e., relying upon a signal of a logic sum OR of the first latch signal RS1 and the second latch signal RS2. Therefore, even when the upper surface of the stacked paper 12*a* is deviated aslant, the operation for raising the table 5 is halted at a moment when the position of the uppermost portion has reached the specified height.

In order to more reliably stack the paper, further, the control operation is more reliably conducted, by using plural uppermost portion sensors of the same constitution, than when the uppermost portion sensor is used in a number of only one.

That is, plural uppermost portion sensors are arranged at positions that will not detect the unstable state in an overlapped manner. Then, it is allowed to reliably control the height of the paper table irrespective of the position of the swing guide, and the uppermost portion of the paper is maintained within the specified range at all times.

In the above-mentioned embodiment, guide means for guiding the paper is used as the swing guide which also serves as the paper-folding mechanism. As the guide means, however, there may be provided a fixed guide. In this case, the paper table may be made to swing right and left to fold the paper.

Further, the above-mentioned embodiment has dealt with the mechanism for raising and lowering the paper table. However, the same effect is obtained even by using the constitution in which the paper table is secured and the guide mechanism moves up and down.

What is claimed is:

1. An apparatus for printing continuous paper comprising:

a printer unit for printing continuous paper;

a paper table on which the continuous paper carried through the printer unit is folded and stacked;

an uppermost portion sensor for detecting the uppermost position of the paper stacked on the paper table;

a guide member for guiding the continuous paper to the paper table;

a moving mechanism for changing the distance between the paper table and the guide member; and a control unit for controlling the moving mechanism based on the output of the uppermost portion sensor to change the distance between the paper table and the guide member, said control unit including means operative when the uppermost portion sensor produces an unstable output due to the position of the paper being stacked to continue operation of the moving mechanism even when the uppermost portion sensor has detected the paper.

2. An apparatus for printing continuous paper according to claim 1, wherein the moving mechanism includes a guide shaft operative to guide the motion of the paper table in an up-and-down direction, a belt wrapped around two pulleys and having the paper table connected to a portion thereof, a motor for rotating one of the pulleys, and a weight attached to the belt on the side opposite to the side on which the belt is connected to the paper table.

3. An apparatus for printing continuous paper comprising:

a printer unit;

a paper-folding mechanism for successively folding the continuous paper carried through the printer unit;

a paper table for stacking the folded paper;

a moving mechanism for moving the paper table up and down;

an uppermost portion sensor for detecting the uppermost position of the paper stacked on the paper table; and a control unit for controlling the rising/lowering motion of the paper table based on the output of the uppermost portion sensor, including means operative when the uppermost portion sensor produces an unstable output due to the position of the paper being stacked, to continue to operate the paper table even when the uppermost portion sensor has detected the paper.

4. An apparatus for printing continuous paper according to claim 3, wherein the moving mechanism includes a guide shaft operative to guide the motion of the paper table in an up-and-down direction, a belt wrapped around two pulleys and having the paper table connected to a portion thereof, a motor for rotating one of the pulleys, and a weight attached to the belt on the side opposite to the side on which the belt is connected to the paper table.

5. An apparatus for printing continuous paper comprising:

a printer unit;

a paper-folding mechanism for successively folding the continuous paper carried through the printer unit;

a paper table for stacking the folded paper;

a moving mechanism for moving the paper table up and down;

an uppermost portion sensor for detecting the uppermost position of the paper stacked on the paper table; and a latch signal-holding circuit for holding the output of the sensor, including means operative when the uppermost portion sensor produces an unstable output due to the position of the paper-folding mechanism, to generate a latch signal effective to prevent the latch signal-holding circuit from changing its output, and means controlling the rising/lowering motion of the paper table by the latch signal.

6. An apparatus for printing continuous paper according to claim 5, wherein the moving mechanism includes a guide shaft operative to guide the motion of the paper table in an up-and-down direction, a belt wrapped around two pulleys and having the paper table connected to a portion thereof, a motor for rotating one of the pulleys, and a weight attached to the belt on the side opposite to the side on which the belt is connected to the paper table.

7. An apparatus for printing continuous paper comprising:

a printer unit;

a paper-folding mechanism for successively folding the continuous paper carried through the printer unit;

a paper table for stacking the folded paper;

a moving mechanism for moving the paper table up and down;

plural uppermost portion sensors provided at different positions facing the paper-folding mechanism for detecting the uppermost position of the paper stacked on the paper table; and plural latch signal-holding circuits for holding the outputs of the plural uppermost portion sensors, including means operative when the uppermost portion sensors produce unstable outputs due to the position of the paper-folding mechanism, to generate latch signals effective to prevent the latch signal-holding circuits from changing their outputs, and means controlling the movement of the paper table when one or more of the plural latch signals have detected the uppermost portion of the paper.

8. An apparatus for printing continuous paper according to claim 7, wherein the moving mechanism includes a guide shaft operative to guide the motion of the paper table in an up-and-down direction, a belt wrapped around two pulleys and having the paper table connected to a portion thereof, a motor for rotating one of the pulleys, and a weight attached to the belt on the side opposite to the side on which the belt is connected to the paper table.

9. A device for stacking continuous paper comprising:

a paper table on which continuous paper is folded and stacked;

an uppermost portion sensor for detecting the uppermost position of the paper stacked on the paper table;

a guide member for guiding the continuous paper to the paper table;

a moving mechanism for changing the distance between the paper table and the guide member; and a control unit for controlling the moving mechanism based on the output of the uppermost portion sensor to change the distance between the paper table and the guide member, wherein, when the uppermost portion sensor produces an unstable output due to the position of the paper being stacked, the control unit operates the moving mechanism to continue its operation even when the uppermost portion sensor has detected the paper.

10. A device for stacking paper according to claim 9, wherein the moving mechanism includes a guide shaft operative to guide the motion of the paper table in an up-and-down direction, a belt wrapped around two pulleys and having the paper table connected to a portion thereof, a motor for rotating one of the pulleys, and a weight attached to the belt on the side opposite to the side on which the belt is connected to the paper table.

11. A device for stacking continuous paper comprising:

a paper-folding mechanism for successively folding continuous paper;

a paper table for stacking the folded paper;

a moving mechanism for moving the paper table up and down;

an uppermost portion sensor for detecting the uppermost position of the paper stacked on the paper table; and a control unit for controlling the rising/lowering motion of the paper table based on the output of the uppermost portion sensor, including means operative when the uppermost portion sensor produces an unstable output due to the position of the paper being stacked, to continue to operate the paper table even when the uppermost portion sensor has detected the paper.

12. A device for stacking paper according to claim 11, wherein the moving mechanism includes a guide shaft operative to guide the motion of the paper table in an up-and-down direction, a belt wrapped around two pulleys and having the paper table connected to a portion thereof, a motor for rotating one of the pulleys, and a weight attached to the belt on the side opposite to the side on which the belt is connected to the paper table.

13. A device for stacking continuous paper comprising:

a paper-folding mechanism for successively folding continuous paper;

a paper table for stacking the folded paper;

a moving mechanism for moving the paper table up and down;

plural uppermost portion sensors provided at different positions facing the paper-folding mechanism for detecting the uppermost position of the paper stacked on the paper table; and plural latch signal-holding circuits for holding the outputs of the plural uppermost portion sensors, including means operative when the uppermost portion sensors produce unstable outputs due to the position of the paper-folding mechanism, to generate latch signals effective to prevent the latch signal-holding circuits from changing their outputs; and means controlling the movement of the paper table when one or more of the plural latch signals have detected the uppermost portion of the paper.

14. A device for stacking paper according to claim 13, wherein the moving mechanism includes a guide shaft operative to guide the motion of the paper table in an up-and-down direction, a belt wrapped around the two pulleys and having the paper table connected to a portion thereof, a motor for rotating one of the pulleys, and a weight attached to the belt on the side opposite to the side on which the belt is connected to the paper table.

15. A device for stacking continuous paper comprising:

a paper-folding mechanism for successively folding continuous paper;

a paper table for stacking the folded paper;

a moving mechanism for moving the paper table up and down;

an uppermost portion sensor for detecting the uppermost position of the paper stacked on the paper table; and a latch signal-holding circuit for holding the output of the sensor means, including means operative when the uppermost portion sensor produces an unstable output due to the position of the paper-folding mechanism, to generate a latch signal effective to prevent the latch signal-holding circuit from changing its output; and means controlling the rising/lowering motion of the paper table by the latch signal.

16. A device for stacking paper according to claim 15, wherein the moving mechanism includes a guide shaft operative to guide the motion of the paper table in an up-and-down direction, a belt wrapped around two pulleys and having the paper table connected to a portion thereof, a motor for rotating one of the pulleys, and a weight attached to the belt on the side opposite to the side on which the belt is connected to the paper table.

* * * * *